US011800294B2

(12) United States Patent
Dehé et al.

(10) Patent No.: US 11,800,294 B2
(45) Date of Patent: Oct. 24, 2023

(54) MEMS TRANSDUCER WITH IMPROVED PERFORMANCE

(71) Applicant: Hahn-Schickard-Gesellschaft für Angewandte Forschung e. V., Villingen-Schwenningen (DE)

(72) Inventors: Alfons Dehé, Reutlingen (DE); Achim Bittner, Heilbronn (DE); Lenny Castellanos, Oberndorf am Neckar (DE)

(73) Assignee: Hahn-Schickard-Gesellschaft für Angewandte Forschung e. V., Villingen-Schwenningen (DE)

( * ) Notice: Subject to any disclaimer, the term of this patent is extended or adjusted under 35 U.S.C. 154(b) by 0 days.

(21) Appl. No.: 17/758,923

(22) PCT Filed: Jan. 15, 2021

(86) PCT No.: PCT/EP2021/050766
§ 371 (c)(1),
(2) Date: Jul. 15, 2022

(87) PCT Pub. No.: WO2021/144400
PCT Pub. Date: Jul. 22, 2021

(65) Prior Publication Data

US 2023/0047856 A1 Feb. 16, 2023

(30) Foreign Application Priority Data

Jan. 17, 2020 (EP) ..... 20152560
Apr. 8, 2020 (EP) ..... 20168836

(51) Int. Cl.
*H04R 17/00* (2006.01)
*H04R 7/12* (2006.01)
(Continued)

(52) U.S. Cl.
CPC ..... *H04R 17/005* (2013.01); *H04R 7/125* (2013.01); *H04R 17/10* (2013.01); *H04R 31/003* (2013.01); *H04R 2201/003* (2013.01)

(58) Field of Classification Search
CPC ..... H04R 2201/003
See application file for complete search history.

(56) References Cited

U.S. PATENT DOCUMENTS

2002/0006208 A1 1/2002 Takei
2019/0116417 A1 4/2019 Liang et al.
2020/0087138 A1* 3/2020 Schenk ..... B81B 3/0021

FOREIGN PATENT DOCUMENTS

JP 3919695 B2 5/2007

OTHER PUBLICATIONS

International Search Report in PCT/EP2021/050766 dated Mar. 25, 2021.

* cited by examiner

*Primary Examiner* — Mark Fischer
(74) *Attorney, Agent, or Firm* — Knobbe Martens Olson & Bear LLP

(57) ABSTRACT

The invention relates to a MEMS transducer comprising a vibratable membrane for generating or receiving pressure waves in a fluid in a vertical direction, wherein the vibratable membrane is supported by a carrier and the vibratable membrane exhibits two or more vertical sections which are formed parallel to the vertical direction and comprise at least one layer of actuator material. The end of the vibratable membrane is preferably connected to an electrode, such that the two or more vertical sections can be induced to vibrate horizontally by driving the at least one electrode, or such that an electrical signal can be generated at the at least one electrode when the two or more vertical sections are induced to vibrate horizontally.

20 Claims, 18 Drawing Sheets

(51) Int. Cl.
*H04R 31/00* (2006.01)
*H04R 17/10* (2006.01)

A

B

Phase 1

Phase 2

E

F

G

A

B

E

F

G

H

I

J

A

B

C

D

E

F

A

B

A

B c

MEMS TRANSDUCER WITH IMPROVED PERFORMANCE

The invention relates to a MEMS transducer comprising a vibratable membrane for generating or receiving pressure waves of a fluid in a vertical direction, wherein the vibratable membrane is supported by a carrier and the vibratable membrane exhibits two or more vertical sections which are formed parallel to the vertical direction and comprise at least one layer of an actuator material. At least one end of the vibratable membrane is preferably connected to an electrode, such that the two or more vertical sections can be induced to produce horizontal vibrations by driving the at least one electrode, or such that an electrical signal can be generated at the at least one electrode when the two or more vertical sections are induced to vibrate horizontally.

BACKGROUND AND PRIOR ART

Today, microsystems technology is used in many fields of application for the manufacture of compact, mechanical-electronic devices. The microsystems (microelectromechanical systems, MEMS for short) that can be manufactured in this way are very compact (micrometer range) with excellent functionality and ever lower manufacturing costs.

MEMS transducers, such as MEMS loudspeakers or MEMS microphones, are also known from the prior art. Current MEMS loudspeakers are mostly designed as planar membrane systems with a vertical drive of a vibratable membrane in the direction of emission. The vibrations are induced, for example, by means of piezoelectric, electromagnetic or electrostatic actuators.

An electromagnetic MEMS loudspeaker for mobile devices is described in Shahosseini et al. 2015. The MEMS loudspeaker features a stiffening silicon microstructure as the sound radiator, with the moving part suspended from a carrier via silicon driving springs to enable large out-of-plane displacements by means of an electromagnetic motor.

Stoppel et al. 2017 discloses a two-way loudspeaker whose concept is based on concentric piezoelectric actuators. As a special feature, the vibrating membrane is not of closed design, but comprises eight piezoelectric unimorph actuators, each consisting of a piezoelectric and a passive layer. The outer woofers consist of four unilaterally clamped actuators with a trapezoidal shape, while the inner tweeters are formed by four triangular actuators connected by spring to a rigid frame. The separation of the membrane should allow an improved sound at higher output.

A disadvantage of such planar MEMS loudspeakers is their limitation in terms of sound power, especially at low frequencies. One reason for this is that the sound pressure level that can be generated is proportional to the square of the frequency for a given displacement. Therefore, for sufficient sound power, either displacements of the vibrating membranes of at least 100 μm or large-area membranes in the square centimeter range are necessary. Both conditions are difficult to realize by means of MEMS technology.

In the prior art, it was therefore proposed to design MEMS loudspeakers which do not have a closed membrane for vibrations in the vertical direction of emission, but a large number of movable elements which can be driven to produce lateral or horizontal vibrations. The advantage of this is that an increased volume flow can be moved on a small surface and thus an increased sound power can be provided.

For example, a MEMS loudspeaker based on this principle is disclosed in US 2018/0179048 A1 or Kaiser et al. 2019.

The MEMS loudspeaker comprises a plurality of electrostatic bending actuators, which are arranged between a top and bottom wafer as vertical lamellae and can be driven to produce lateral vibrations by means of appropriate control. Here, an inner lamella forms an actuator electrode opposite two outer lamellae. Except for a connection node of electrodes which are still galvanically separated, there is an air gap between the three bent lamellae. If a potential is applied inside against outside, this leads to an attraction on both sides due to the curvature of the design in the direction of a preferred direction, which is predefined by an anchor. The bulges of the outer lamellae are used for mobility. The restoring force is provided by a mechanical spring force. Pull-push operation is therefore not possible.

Another disadvantage is that gaps between the bending actuators and the lid/bottom wafers, which are necessary for their mobility, lead to ventilation between the two chambers. This limits the lower cutoff frequency. Furthermore, the lateral movement of the bending actuators and thus the sound power is limited in order to avoid a pull-in effect and acoustic breakdown.

An alternative MEMS-based air pulse or sound generation system is described in US 2019/0116417 A1. The device comprises a front chamber as well as a rear chamber and a plurality of valves, wherein the front and rear chambers are separated from each other by means of a folded membrane. In one embodiment, the folded membrane has a rectangular meander structure in cross-section with horizontal and vertical sections. Piezo actuators are positioned on the respective horizontal sections to cause lateral movement of the vertical sections by synchronized stretching or compression of the horizontal sections. With the proposed principle, an increased volume flow and thus sound power can also be generated on a small chip surface.

One disadvantage, however, is the increased effort required for the synchronized drive of the piezo actuators. There is also potential for improvement in terms of the volume displaced by the lateral vibrations, which is limited by the geometric arrangement of the unilaterally driven horizontal sections.

From US 2002/006208 A1 and JP 3 919695 B2 a piezoelectric loudspeaker is known, in which two piezoelectric films are formed into a membrane with an accordion shape. In folded form, the membrane is laterally clamped respectively by a pair of corrugated plates, which are secured, for example, by means of screw connections and stabilize the vibrating membrane as a composite side frame. A plurality of electrodes are applied in structured form to the peaks and troughs of the membrane and are insulated from each other by strips of non-conductive material. Electrode cables are arranged in the pair of plates or side frame in order to drive the electrodes. Alternatively, the pair of plates can also be formed at least partially from a conductive material.

The macroscopic piezoelectric loudspeaker US 2002/006208 A1 and JP 3 919695 B2 is obtained in an assembly process which cannot be miniaturized in an obvious way to obtain a MEMS loudspeaker. In particular, the intended clamping of the membrane in a two-part side frame, the structured attachment of multiple electrodes onto wave crests and troughs of the membrane, or the connection of the electrodes with electrode cables in the side frame is not transferable to a MEMS process.

Thus, in light of the disadvantages of the prior art, there is a need for alternative or improved solutions for MEMS-based loudspeakers.

OBJECTIVE OF THE INVENTION

The objective of the invention is to provide a MEMS transducer, in particular a MEMS loudspeaker or MEMS microphone, as well as a method for manufacturing the MEMS transducer, which do not exhibit the disadvantages of the prior art. In particular, one objective of the invention was to provide a high-performance MEMS loudspeaker or a MEMS microphone with high sound quality or audio quality, which at the same time are characterized by a simple, inexpensive and compact design.

SUMMARY OF THE INVENTION

The objective is solved by the features of the independent claims. Preferred embodiments of the invention are described in the dependent claims.

The invention preferably relates to a MEMS transducer for interacting with a volumetric flow of a fluid comprising.

a carrier, a vibratable membrane for generating or receiving pressure waves of the fluid in a vertical direction, the vibratable membrane being supported by the carrier and wherein the vibratable membrane has two or more vertical sections formed substantially parallel to the vertical direction and comprising at least one layer of an actuator material, at least one end of the vibratable membrane being connected to at least one electrode, such that by driving the at least one electrode the two or more vertical sections can be induced to produce substantially horizontal vibrations or such that when the two or more vertical sections are induced to vibrate substantially horizontally an electrical signal can be generated at the at least one electrode.

Particularly preferably, the MEMS transducer may be a MEMS loudspeaker. In a particularly preferred embodiment, the invention relates to a MEMS loudspeaker comprising a carrier, a vibratable membrane for generating sound waves in a vertical direction of emission, the vibratable membrane being supported by the carrier, wherein the vibratable membrane has two or more vertical sections which are formed substantially parallel to the direction of emission and comprise at least one layer of an actuator material, wherein at least one end of the vibratable membrane is preferably connected to at least one electrode such that the two or more vertical sections can be induced to produce substantially horizontal vibrations by driving the at least one electrode.

This design of the MEMS loudspeaker can achieve a MEMS loudspeaker with high sound power and simplified control.

Unlike known planar MEMS loudspeakers, the vibratable membrane itself does not need to be operated over a large area of several square centimeters or with a displacement greater than 100 μm to generate sufficient sound pressure. Instead, the plurality of the vertical sections of the vibratable membrane can move an enlarged total volume in the vertical direction of emission with small horizontal or lateral movements of a few micrometers.

Compared to solutions according to US 2018/0179048 A1 or Kaiser et al. 2019, the claimed MEMS loudspeaker is characterized by a simplified structure, control and manufacturing process.

In particular, providing the vertical lamellae or bending actuators for a MEMS loudspeaker according to Kaiser et al. 2019 is complex. In addition, sufficiently precise vertical etchings are only possible for limited lamella heights, which limits the sound power.

By means of the solution according to the invention, the vertical sections of the vibratable membrane can instead be achieved in MEMS design by means of simple manufacturing steps, as will be explained in detail below. Moreover, the actuator principle according to the invention avoids pull-in or sticking of the vertical sections. In contrast to the solution of Kaiser et al. 2019, the single-side electrodes do not obtain potential differences in a gap between the vertical sections. In addition to avoiding an overvoltage or a pull-in, this can also reduce dust accumulation, since, for example, an external electrode can be placed on a ground potential.

Another particular advantage of the described MEMS loudspeaker is the simplified drive. While in US 2019/0116417 A1 a plurality of piezoelectric actuators must be connected at the horizontal sections, the proposed MEMS loudspeaker can be driven by means of at least one end-side electrode. This reduces the manufacturing cost, minimizes sources of error, and also inherently leads to synchronous control of the vertical sections to produce horizontal vibrations.

In this way, the air volumes present between the vertical sections can be moved extremely precisely by the horizontal vibrations along the vertical direction of emission. This results in an improved sound, even at high sound power levels.

A "MEMS loudspeaker" preferably means a loudspeaker which is based on MEMS technology and whose sound-generating structures at least partially have dimensions in the micrometer range (1 μm to 1000 μm). Preferably, for example, the vertical sections of the vibratable membrane may have dimensions in the range of less than 1000 μm in width, height and/or thickness. Here, it may also be preferred that, for example, only the height of the vertical sections are dimensioned in the micrometer range, while, for example, the length may have a larger dimension and/or the thickness a smaller size.

Advantageously, the design of the vibratable membrane can be used not only to form a MEMS loudspeaker with high sound power and simplified control. Likewise, for example, the provision of a particularly powerful MEMS microphone with high audio quality is made possible.

Thus, in a preferred embodiment, the invention further relates to a MEMS microphone comprising a carrier, a vibratable membrane for receiving sound waves in a vertical direction, the vibratable membrane being supported by the carrier, and wherein the vibratable membrane has two or more vertical sections which are formed parallel to the vertical direction and comprise at least one layer of an actuator material, wherein at least one end of the vibratable membrane is preferably connected to at least one electrode, such that when the two or more vertical sections are induced to vibrate horizontally an electrical signal can be generated at the at least one electrode.

The design of the MEMS microphone is structurally similar to that of the MEMS loudspeaker, in particular with regard to the design of the vibratable membrane. Instead of driving the electrodes to generate horizontal vibrations and thus sound pressure waves, the MEMS microphone is designed to receive sound pressure waves in the same vertical direction. Preferably, there are air volumes between the vertical sections, which are moved along a vertical detection direction when sound waves are received. The sound pressure waves induce the vertical sections to vibrate horizontally such that the actuator material generates a corresponding periodic electrical signal.

A "MEMS microphone" preferably means a microphone which is based on MEMS technology and whose sound-receiving structures at least partially have dimensions in the micrometer range (1 μm to 1000 μm). Preferably, for example, the vertical sections of the vibratable membrane may have dimensions in the range of less than 1000 μm in width, height and/or thickness. Here, it may also be preferred that, for example, only the height of the vertical sections are dimensioned in the micrometer range, while, for example, the length may have a larger dimension and/or the thickness a smaller size.

The term MEMS transducer thus refers to both a MEMS microphone and a MEMS loudspeaker. In general, the MEMS transducer refers to a transducer for interaction with a volume flow of a fluid, which is based on MEMS technology and whose structures for interaction with the volume flow or for receiving or generating pressure waves of the fluid have dimensions in the micrometer range (1 μm to 1000 μm). The fluid can be a gaseous fluid as well as a liquid fluid. The structures of the MEMS transducer, in particular the vibratable membrane, are designed to generate or receive pressure waves of the fluid.

For example, as in the case of a MEMS loudspeaker or MEMS microphone, this may concern sound pressure waves. However, the MEMS transducer may equally be suitable as an actuator or sensor for other pressure waves. The MEMS transducer is thus preferably a device which converts pressure waves (e.g. acoustic signals as sound pressure waves) into electrical signals or vice versa (conversion of electrical signals into pressure waves, for example acoustic signals).

Applications of the MEMS transducer as an energy harvester are also possible, using pneumatic or hydraulic alternating pressures. In these cases, the electrical signal can be dissipated as recovered electrical energy, stored or supplied to other (consumer) devices.

End-side preferably means a positioning at one end of the vibratable membrane of the at least one electrode such that a connection can be established with an electronic system, e.g. to a current or voltage source in the case of a MEMS loudspeaker, preferably at an end at which the membrane is suspended from the carrier. Electrode preferably means a region made of a conductive material (preferably a metal) which is adapted for such establishment of a connection with an electronic system, e.g. a current and/or voltage source in the case of a MEMS loudspeaker. Preferably, the material may be an electrode pad. Particularly preferably, the electrode pad is used for establishing a connection with an electronic system and is itself connected to a conductive metal layer, which may extend over the entire surface of the vibratable membrane. In part, the conductive layer together with an electrode pad is referred to in the following as an electrode, for example as a top electrode or bottom electrode.

Particularly preferably, the layer of conductive material, preferably metal, in the sense of a top or bottom electrode is present as a continuous or full-surface or coherent layer of the vibratable membrane, which forms a substantially homogeneous surface and in particular is not structured. Instead, preferably by means of an unstructured layer of conductive material, preferably metal, the two or more vertical sections are connected to the end-side electrodes or the electrode pad.

Advantageously, it is in particular not necessary to create separate connecting regions for different vertical sections of the vibratable membrane. In contrast to the approach for a macroscopic piezoelectric loudspeaker according to US 2002/006208 A1 and JP 3 919695 B2, the attachment of a structured top or bottom electrode is not necessary. Instead, a top or bottom electrode can be applied in each case as a continuous layer of conductive material, which is connected by means of at least one end-side electrode or electrode pad. The manufacturing process is thus significantly simplified and allows the provision of miniaturized MEMS transducers in large quantities by means of a batch process.

In preferred embodiments, the MEMS transducer comprises two end-side electrodes. Preferably, with the connection to an electronic system, e.g., a current or voltage source, can be established with the electrodes at opposite ends of the vibratable membrane, between which the two or more vertical sections are present, such that the actuator layer(s) in the vertical sections can be driven by means of the end-side electrodes.

The end-side provision of the electrodes is thus preferably distinguished from a means of connection which actuates the respective vertical sections with respectively separate electrodes or, in the case of a MEMS microphone, receives generated electrical signals. Preferably, the MEMS transducer thus comprises exactly one or exactly two electrodes for end-side connection and no further electrodes/electrode pads for connecting central vertical sections.

Preferably, the layer of actuator material in the vertical sections serves as a component of a mechanical biomorph, wherein a lateral curvature of the vertical sections is induced by driving the actuator layer via the electrode, or wherein a corresponding electrical signal is generated by an induced lateral curvature.

In a preferred embodiment, the two or more vertical sections exhibit at least two layers, wherein one layer comprises an actuator material and a second layer comprises a mechanical support material, and wherein at least the layer comprising the actuator material is connected to an end-side electrode, such that the horizontal vibrations are producible by a change in shape of the actuator material relative to the mechanical support material. In the embodiment, the mechanical bimorph is formed by a layer of actuator material (e.g. a piezoelectric material) and a passive layer that acts as a mechanical support layer. Both a transverse and longitudinal piezoelectric effect can be used for bending.

When the actuator layer is driven, it can, for example, undergo transverse or longitudinal stretching or compression. This generates a stress gradient relative to the mechanical support layer, which causes a lateral curvature or vibration. As illustrated in FIG. 1, alternating polarity at the electrodes can preferably result in push-pull operation, whereby alternately almost the entire air volume between the vertical sections can be moved in the vertical direction of emission.

The advantage of the actuator principle is thus a highly efficient translation of the horizontal vibrations of vertical sections into a vertical volume movement or sound generation.

Since the actuator principle is not based on electrostatic attraction but on a relative change in shape (e.g. compression, stretching, shearing) of the actuator layer relative to a supporting layer, it is possible to rule out sticking of the membrane sections. Instead, the vertical sections can touch each other and are thus not restricted in their displacement.

In a further preferred embodiment, the two or more vertical sections comprise at least two layers, wherein both layers comprise an actuator material and are connected to respective end-side electrodes, and the horizontal vibrations can be generated by a change in shape of one layer relative to the other layer. In the embodiment, the horizontal vibration of the vertical sections is thus not generated by a stress gradient between an active actuator layer and a passive support layer, but by a relative change in shape of two active actuator layers.

The actuator layers can be made of the same actuator material and can be driven differently. The actuator layers can also be made of different actuator materials, for example piezoelectric materials with different deformation coefficients.

Within the meaning of the invention, the "layer comprising an actuator material" is preferably also referred to as an actuator layer. An actuator material preferably means a material which undergoes a change in shape, for example stretching, compression or shearing, when an electrical voltage is applied, or conversely generates an electrical voltage when its shape is changed.

Preferred materials are those with electric dipoles, which undergo a change in shape when an electric voltage is applied, wherein the orientation of the dipoles and/or of the electric field can determine the preferred direction of the shape changes.

Preferably, the actuator material may be a piezoelectric material, a polymer piezoelectrical material, and/or electroactive polymers (EAP).

Particularly preferably, the piezoelectric material is selected from a group comprising lead zirconate titanate (PZT), aluminum nitride (AlN), aluminum scandium nitride (AlScN), and zinc oxide (ZnO).

Polymer piezoelectric materials preferably include polymers which exhibit internal dipoles and thus impart piezoelectric properties. This means that when an external electrical voltage is applied, the piezoelectric polymer materials (in a manner similar to the aforementioned classic piezoelectric materials) undergo a change in shape (e.g. compression, stretching or shearing). An example of a preferred piezoelectric polymer material is polyvinylidene fluoride.

Hereby, a macroscopic solution can be realized in which a polymer piezoelectrical material layer is provided on a mechanical support layer and wound over an upper and lower comb. Preferably, a polymer piezoelectrical material layer (including an electrode) is first provided on a support layer (possibly including a counter electrode). Subsequently, an upper and lower comb (preferably of a MEMS structure) are moved against each other in such a way that a folded membrane with actuatable vertical sections is formed.

Within the meaning of the invention, the "layer comprising a mechanical support material" is preferably also referred to as a support layer. The mechanical support material or support layer preferably serves as a passive layer that can resist a change in shape of the actuator layer. Unlike an actuator layer, the mechanical support material preferably does not change shape when an electrical voltage is applied. Preferably, the mechanical support material is electrically conductive, so that it can also be used directly for contacting the actuator layer. However, in some embodiments it may also be non-conductive and, for example, be coated with an electrically conductive layer.

Particularly preferably, the mechanical support material is monocrystalline silicon, a polysilicon or a doped polysilicon.

While the actuator layer undergoes a change in shape when an electrical voltage is applied, the layer of the mechanical support material remains substantially unchanged. The resulting stress gradient between the two layers (mechanical bimorph) preferably causes a horizontal curvature. For this purpose, the thickness of the support layer compared to the thickness of the actuator layer is preferably chosen such that a sufficiently large stress gradient is generated for the curvature. For doped polysilicon as a mechanical support material and a piezoelectric material such as PZT or AlN, for example, substantially equal thicknesses, preferably between 0.5 μm and 2 μm, have proven to be particularly suitable.

Terms such as substantially, approximately, about, etc. preferably describe a tolerance range of less than ±20%, preferably less than ±10%, even more preferably less than ±5% and in particular less than ±1%. Indications of substantially, approximately, about, etc. always also disclose and include the exact value mentioned.

With periodic driving the actuator layer, e.g. by means of an AC voltage, horizontal vibrations can thus be generated quickly and precisely for sound emission.

To ensure horizontal vibration, the piezoelectric material can preferably have a C-axis orientation perpendicular to the surface of the vertical sections so that a transverse piezoelectric effect is utilized. Other orientations and, for example, the use of a longitudinal piezoelectric effect to form the horizontal curvatures or vibrations (see FIG. 1) may also be preferred.

Electrical connection of the actuator layer and/or the layer made of a mechanical support material and thus the application of an electrical voltage can take place directly via the end-side electrodes or be assisted by a layer made of a conductive material.

In a preferred embodiment, therefore, the vibratable membrane comprises at least one layer of a conductive material.

In preferred embodiments, the conductive material is selected from a group comprising platinum, tungsten, (doped) tin oxide, monocrystalline silicon, polysilicon, molybdenum, titanium, tantalum, titanium-tungsten alloy, metal silicide, aluminum, graphite, and copper.

The directional indications vertical and horizontal (or lateral) preferably refer to a preferred direction in which the vibratable membrane is oriented for generating or receiving pressure waves of the fluid. Preferably, the vibratable membrane is suspended horizontally between at least two side regions of a carrier, while the vertical direction (direction of interaction with the fluid) for generating or receiving pressure waves is orthogonal thereto. In the case of a MEMS loudspeaker, the vertical direction (of interaction) corresponds to the vertical direction of sound emission of the MEMS loudspeaker. In this case, vertical preferably means the direction of sound emission, while horizontal means a direction orthogonal to it. In the case of a MEMS microphone, the vertical direction (of interaction) corresponds to the vertical direction of sound detection of the MEMS microphone. In this case, vertical preferably means the direction of sound detection or recording, while horizontal means a direction orthogonal to it.

Thus, the vertical sections of the vibratable membrane preferably denote sections of the vibratable membrane that are oriented substantially in the direction of emission of a MEMS loudspeaker or direction of detection of a MEMS microphone. The person skilled in the art understands that it need not be an exact vertical alignment, but preferably the vertical sections of the vibratable membrane are aligned substantially in the direction of emission of a MEMS loudspeaker or direction of detection of a MEMS microphone.

In a preferred embodiment, the vertical sections are oriented substantially parallel to the vertical direction, whereby substantially parallel means a tolerance range of ±30°, preferably ±20°, more preferably ±10° about the vertical direction.

The vibratable membrane can therefore preferably exhibit not only a rectangular meander shape in cross-section, but also a curved or wavy shape or a sawtooth shape (zigzag shape).

Preferably, the vertical and/or horizontal sections are straight at least in sections or over their entire length, but the vertical and/or horizontal sections can also be curved at least in sections or over their entire length. In the case of a curved or wavy shape of the vibratable membrane in cross-section, the alignment preferably refers to a tangent to the curved vertical and/or horizontal sections at their respective midpoints.

While the vibratable membrane is preferably horizontal to the direction of sound emission or direction of sound detection, the sound waves are generated by driving the vertical sections or detected vice versa.

In a preferred embodiment of the invention, the carrier comprises two side regions between which the vibratable membrane is disposed in the horizontal direction.

The carrier is preferably a frame structure, which is substantially formed by a continuous outer border in the form of side walls of an area that remains free. The frame structure is preferably stable and resistant to bending. In the case of an angular frame shape (triangular, quadrangular, hexagonal or generally polygonal outline), the individual side regions which preferably substantially form the frame structure are called side walls in particular.

The vibratable membrane is preferably held by at least two side walls of the carrier. In the examples in FIGS. 1-9, the two side walls can be seen in cross-section.

Preferably, however, the preferred carrier comprises four side regions, with additional end faces generally parallel to the drawn cross-section. These additional two side walls span the framing structure.

The vibratable membrane is preferably suspended in a planar manner within the free area. The planar extension of the vibratable membrane indicates a horizontal direction, while the vertical sections are substantially orthogonal thereto. With respect to the end faces, the membrane may be adhered to these side walls or slotted there for greater mobility. Advantageously, the slot may represent a dynamic high-pass filter which couples, for example, a front volume and rear volume.

In a preferred embodiment of the invention, the carrier is formed from a substrate, preferably selected from the group consisting of monocrystalline silicon, polysilicon, silicon dioxide, silicon carbide, silicon germanium, silicon nitride, nitride, germanium, carbon, gallium arsenide, gallium nitride, indium phosphide, and glass.

These materials are easy and inexpensive to process in semiconductor and/or microsystem manufacturing and are suitable for large-scale manufacturing. The carrier structure can be flexibly manufactured based on the materials and/or manufacturing methods. In particular, it is preferably possible to manufacture the MEMS transducer comprising a vibratable membrane together with a carrier in one (semiconductor) process, preferably on a wafer. This further simplifies and cheapens the manufacturing process such that a compact and robust MEMS transducer can be provided at low cost.

In a preferred embodiment, the vibratable membrane is formed by a lamellar structure or meander structure. Preferably, the specification of a lamellar or meander structure refers to the shape of the vibratable membrane in cross-section.

A lamellar structure preferably refers to an arrangement of similar, parallel layers, which preferably form the vertical sections. The individual lamellae are preferably oriented with their surface substantially parallel to the vertical direction, preferably a direction of emission or detection. Preferably, the lamellae are multilayered and form a mechanical biomorph. For example, the lamellae can each comprise an actuator layer as well as a passive layer made of a support material and/or two differently controllable actuator layers.

The person skilled in the art understands that it does not have to be an exact parallel alignment of the lamellae to the vertical direction, but rather the lamellae are preferably aligned substantially in the direction of emission of a MEMS loudspeaker or direction of detection of a MEMS microphone.

In a preferred embodiment, the vertical sections or lamellae are oriented substantially parallel to the vertical direction, whereby substantially parallel means a tolerance range of ±30°, preferably ±20°, particularly preferably ±10° about the vertical direction.

It may be preferred that the lamellae are planar, which means in particular that their extension in each of the two dimensions (height, width) of their plane is greater than in a dimension perpendicular thereto (thickness). For example, size ratios of at least 2:1, preferably at least 5:1, 10:1 or more may be preferred.

Preferably, the vibratable membrane has a plurality of lamellae forming the vertical sections. For example, 2, 3, 4, 5, 10, 15, 20, 30, 40, 50 or more lamellae may be preferred. This realizes a high degree of efficiency for a desired sound emission or sound detection in a confined space.

In the embodiment, the vibratable membrane is preferably formed by the lamellae as vertical sections, which are connected to each other via conductive bridges or horizontal sections. Suitable bridges are, for example, metal bridges (see FIG. 10) or bridges made of other conductive materials. The conductive bridges ensure on the one hand the mechanical integrity of the vibratable membrane. On the other hand, the conductive bridges advantageously permit the connection of all the lamellae by means of end-side electrodes. Advantageously, the lamellae can thus be synchronously driven to produce horizontal vibrations or detect the same with minimal complexity in their control and manufacturing.

A meander structure preferably refers to a structure formed by a sequence of sections substantially orthogonal to each other in cross-section. The mutually orthogonal sections are preferably vertical and horizontal sections of the vibratable membrane. Particularly preferably, the meander structure is rectangular in cross-section. However, it may also be preferred that the meander structure has a sawtooth shape (zigzag shape) in cross-section or is curved or wave-shaped. This is particularly the case if the vertical sections are not aligned exactly parallel with the vertical direction of emission or detection, but constitute an angle of, for example, ±30°, preferably ±20°, particularly preferably ±10° with the vertical direction.

In preferred embodiments, the horizontal sections may also not be exactly at an orthogonal angle of 90° to the vertical direction of emission or detection, but may, for example, constitute an angle between 60° and 120°, preferably between 70° and 110°, particularly preferably between 80° and 100° with the vertical direction.

In the case of a curved or wavy shape of the vertical and/or horizontal sections of the vibratable membrane in cross-section, the alignment preferably refers to a tangent to the vertical and/or horizontal sections at their respective midpoints.

The meander structure thus preferably corresponds to a membrane folded along its width. Within the meaning of the invention, a vibratable membrane can therefore preferably also be referred to as bellows. The parallel folds of the bellows preferably form the vertical sections. The connecting sections between the folds preferably form the horizontal sections. Preferably, the vertical sections are longer than the horizontal sections, for example by a factor of 1.5, 2, 3, 4 or more.

With regard to the function of a vibratable membrane in meander form for generating or receiving sound waves, the vertical sections are decisive, in a manner similar to the lamellae described above. Preferably, the vertical sections are multilayered and form a mechanical biomorph. For example, the vertical sections may each comprise an actuator layer as well as a passive layer made of a support material and/or two differently controllable actuator layers. Preferably, the horizontal sections of the folded membrane can be constructed identically to the vertical sections (see inter alia FIG. 3-7). However, it may be equally preferred that the horizontal sections—in contrast to the vertical sections—do not exhibit an actuator layer, but rather only a mechanical support layer and/or an electrically conductive layer.

In a preferred embodiment, the at least one layer of an actuator material of the vibratable membrane is a continuous layer. Continuous preferably means that there are no interruptions in the cross-sectional profile. Accordingly, it is preferred in said embodiment that there is a continuous layer of actuator material in both the vertical and horizontal sections. Advantageously, no structuring is necessary. A continuous layer is particularly easy to manufacture and ensures synchronous driving during operation of a MEMS loudspeaker.

The performance of the MEMS transducer, in particular a MEMS loudspeaker or MEMS microphone, can be significantly determined by the number and/or dimensions of the vertical sections.

In preferred embodiments, the vibratable membrane comprises more than 3, 4, 5, 10, 15, 20, 30, 40, 50, 100 or more vertical sections.

In preferred embodiments, the vibratable membrane comprises less than 10000, 5000, 2000, or 1000 or fewer vertical sections.

The preferred number of vertical sections results in high sound power on the smallest chip surfaces without sacrificing the sound or audio quality.

Preferably, the vertical sections are planar, meaning in particular that their extension in each of the two dimensions (height, width) of their plane is greater than in a dimension perpendicular thereto (thickness). For example, size ratios of at least 2:1, preferably at least 5:1, 10:1 or more may be preferred.

Within the meaning of the invention, the height of the vertical sections preferably corresponds to the dimension along the direction of sound emission or sound detection, while the thickness of the vertical sections preferably corresponds to the sum of the layer thickness of the one or more layers forming the vertical sections. The length of the vertical sections preferably corresponds to a dimension orthogonal to the height or thickness. In the cross-sectional views of the figures below, the height and thickness are shown schematically (not necessarily true to scale), while the dimension of the length corresponds to a (non-visible) drawing depth of the figures.

In a preferred embodiment, the height of the vertical sections is between 1 μm and 1000 μm, preferably between 10 μm and 500 μm. Intermediate ranges from the above ranges may also be preferred such as 1 μm to 10 μm, 10 μm to 50 μm, 50 μm to 100 μm, 100 μm to 200 μm, 200 μm to 300 μm, 300 μm to 400 μm, 400 μm to 500 μm, 600 μm to 700 μm, 700 μm to 800 μm, 800 μm to 900 μm, or even 900 μm to 1000 μm. A person skilled in the art will recognize that the aforementioned range limits can also be combined to obtain other preferred ranges, such as 10 μm to 200 μm, 50 μm to 300 μm, or even 100 μm to 600 μm.

In a preferred embodiment, the thickness of the vertical sections is between 100 nm and 10 μm, preferably between 500 nm and 5 μm. Intermediate ranges from the above ranges may also be preferred such as 100 nm to 500 nm, 500 nm to 1 μm, 1 μm to 1.5 μm, 1.5 μm to 2 μm, 2 μm to 3 μm, 3 μm to 4 μm, 4 μm to 5 μm, 5 μm to 6 μm, 6 μm to 7 μm, 7 μm to 8 μm, 8 μm to 9 μm, or even 9 μm to 10 μm. A person skilled in the art will recognize that the aforementioned range limits can also be combined to obtain other preferred ranges, such as 500 nm to 3 μm, 1 μm to 5 μm, or even 1500 nm to 6 μm.

In a preferred embodiment, the length of the vertical sections is between 10 μm and 10 mm, preferably between 100 μm and 1 mm. Intermediate ranges from the aforementioned ranges may also be preferred, such as 10 μm to 100 μm, 100 μm to 200 μm, 200 μm to 300 μm, 300 μm to 400 μm, 400 μm to 500 μm, 500 μm to 1000 μm, 1 mm to 2 mm, 3 mm to 4 mm, 4 mm to 5 mm, 5 mm to 8 mm, or even 8 mm to 10 mm. A person skilled in the art will recognize that the aforementioned range limits can also be combined to obtain other preferred ranges, such as 10 μm to 500 μm, 500 μm to 5 μm, or even 1 mm to 5 mm.

With the aforementioned preferred dimensioning of the vibratable membrane and the vertical sections, a particularly compact MEMS transducer, in particular MEMS loudspeaker or MEMS microphone, can be provided, which simultaneously combines high performance with excellent sound or audio quality.

In a preferred embodiment of the invention, the vibratable membrane is formed by a meandering structure having alternating vertical and horizontal sections, with retaining structures attached to at least two of the horizontal sections, said retaining structures being directly or indirectly connected to the carrier. For example, the retaining structures may be provided by substrate material of the carrier, i.e., the retaining structures may be formed directly from the substrate of a bottom wafer. Alternatively, it is also possible that the retaining structures are connected to the horizontal sections as separate ridges or elevations of a top wafer.

The retaining structures may preferably be present on one and/or both sides of the vibratable membrane, i.e., preferably on upper and/or lower horizontal sections.

In particular when suspending a larger vibratable membrane between the side walls of a carrier, the use of retaining structures advantageously allows stabilization without negatively affecting sound generation or sound capture.

Since the horizontal sections in a meander shape are at least substantially mechanically neutral, locking them by means of the retaining structure advantageously does not lead to any undesirable stresses between the membrane and the retaining structure or carrier.

Different layers can be provided for the structure of the vibratable membrane to ensure the described driving and induction of horizontal vibrations or their detection.

Connecting one or more actuator layer(s) and/or one or more layer(s) of a mechanical support material, and thus applying or detecting an electrical voltage, can be achieved directly via the end-side electrodes or assisted by a layer of a conductive material.

In a preferred embodiment, therefore, the vibratable membrane comprises at least one layer of a conductive material.

In preferred embodiments, the conductive material is selected from a group comprising platinum, tungsten, (doped) tin oxide, monocrystalline silicon, polysilicon, molybdenum, titanium, tantalum, titanium-tungsten alloy, metal silicide, aluminum, graphite, and copper.

In a preferred embodiment, the vibratable membrane comprises three layers, an upper layer formed of a conductive material and connected to an upper electrode, a middle layer formed of the actuator material, and a lower layer formed of a conductive material.

Preferably, the conductive material of the upper and/or lower layer can be a mechanical support material, such that this layer has a dual function. On the one hand, the layer ensures the connection of the actuator layer to an electrical potential which can be applied to the end-side electrodes. On the other hand, it acts as a mechanical support layer in the manner described for generating horizontal curvatures or vibrations when the actuator layer is driven accordingly.

Such an embodiment can be realized by means of simple manufacturing steps, as illustrated by way of example in FIG. 2. In the preferred embodiment shown in FIG. 2G, FIG. 3 and FIG. 4, the vibratable membrane has a meander structure with a continuous top layer of conductive material (metal), a continuous middle layer of actuator material, and a bottom layer of conductive mechanical support material. A reverse ordering of the layers or another additional conductive layer in contact with the mechanical support layer and/or actuator layer for improved connection may also be provided.

In another preferred embodiment, the vibratable membrane comprises two layers of actuator material separated by a middle layer of conductive material, preferably metal, wherein the middle layer is connected to a first electrode and at least one of the two layers of actuator material is connected to a second electrode via another layer of conductive material, preferably metal.

As explained above, in a preferred embodiment, two actuator layers can also be used, for example to move the vertical sections in horizontal vibrations by means of differing drives. In order to transmit the electrical potential changes from the end-side electrodes to the respective actuator layer, two or more intermediate layers of a conductive material can preferably be provided. Preferably, the layers of conductive material, for example of a metal, in this case preferably serve exclusively for connection and not as a mechanical support layer. The stress required to induce curvature or vibration in the sense of a bimorph for a MEMS loudspeaker is itself induced by differing control of the actuator layers themselves.

Preferably, the layers of a conductive material, such as metal, can therefore be made particularly thin (less than 500 nm, preferably less than 200 nm).

FIG. 5 shows an example of such a preferred embodiment. This has a vibratable membrane as a meander structure with two layers of an actuator material, which are separated by a middle layer of a conductive material (metal). The middle layer is connected to a first end-side electrode pad, while the upper actuator layer is connected to a second end-side electrode via a further layer of conductive material. A lower layer of conductive material is not connected to any of the electrodes. A reverse ordering of the layers or an omission of the lower layer of conductive material, which is not in contact with the electrodes, can also be provided.

In the above-described embodiments, it is preferred that the actuator layer(s) and, if applicable, the mechanical support layers are continuous, i.e., run in cross-section from one end of the membrane (at which a first electrode is preferably present) over several alternating horizontal and vertical sections to a second end of the membrane (at which a second electrode is preferably present).

It was recognized by the inventors that for the operating principle of the MEMS transducer, preferably a MEMS loudspeaker, a provision of a mechanical biomorph in the vertical sections is sufficient.

In a preferred embodiment, the at least one actuator layer is not continuous, but is only present in the vertical sections, but not in the horizontal sections. In this case, it may both be preferable for a mechanical support layer, if present, to run continuously, or not to run continuously and be provided only in vertical sections, for example. In order to be able to connect the vertical sections by means of end-side electrodes, it is preferable to apply one or more continuous layers of a conductive material (preferably metal).

A preferred manufacturing process for an embodiment with a non-continuous actuator layer is illustrated in FIG. 7. Here, a selective spacer etching of the actuator layer can be performed in horizontal sections, so that only the vertical sections of the membrane have a layer of actuator material. A continuous layer of mechanical support material may be dielectric at the same time to avoid a short circuit between an upper and lower conductive layer (also called top and bottom electrode).

This embodiment is characterized by particularly effective driving and high performance, in which only the vertical sections are induced to alternately curve or vibrate, while the horizontal sections remain mechanically neutral. Advantageously, the displaced volume can be increased even further per phase of the driving.

In the above-described embodiments, a vibratable membrane in meander form is preferably realized by applying or etching suitably functional layers.

Alternatively, a vibratable membrane can also be manufactured by providing vertical sections and connecting them using metal bridges.

In a preferred embodiment, the vertical sections of the vibratable membrane comprise two layers, wherein a first layer consists of an actuator material, a second layer consists of a flexible support material, and wherein the vertical sections are connected by horizontal metal bridges.

As illustrated in FIG. 10, several individual piezoceramic elements comprising a layer of mechanical support material and a layer of piezoelectric material, as well as a sacrificial layer, can preferably be provided for this purpose. Via multiple process steps comprising interlayer connection and metal filing as well as stacking and dicing of the piezoceramic elements, a membrane with high efficiency can be achieved advantageously in a robust and process-efficient manner.

In this embodiment, a continuous, homogeneous conductive layer is not necessary. Instead, connection of the actuator layer in the vertical sections is ensured by the metal bridges and a conductive mechanical support material.

In a preferred embodiment, the vibratable membrane is coated with a layer of non-stick material. Non-stick material means, in particular, materials with low surface energies that are largely inert to the environment and thus prevent the deposition of dust or other undesirable particles. By way of example, the non-stick materials may be formed by carbon layers, e.g. diamond-like carbon (DLC) layers or also layers comprising perfluorocarbons (PFC), such as polytetrafluoroethylene (PTFT).

In a preferred embodiment of the invention, the MEMS transducer, preferably a MEMS loudspeaker comprises a control unit configured for driving the at least one electrode such that the two or more vertical sections are induced to produce horizontal vibrations. Preferably, the control unit is configured for driving the electrodes ensuring a frequency of the horizontal vibrations between 10 Hz and 20 kHz.

In a preferred embodiment of the invention, the MEMS transducer, preferably a MEMS microphone, comprises a control unit configured for detection of an electrical signal provided by the at least one electrode, said electrical signal having been generated by horizontal vibrations of the two or more vertical sections. Preferably, the control unit of a MEMS microphone is configured for receiving and processing an electrical signal corresponding to a frequency of the horizontal vibrations between 10 Hz and 20 kHz and thus is adapted for sound detection in the audible range.

The control unit is therefore preferably configured and adapted to drive the vibratable membrane (or the actuator layer(s) in the vertical sections) by means of electrical signals, to produce horizontal vibrations and a sound emission in the audible frequency range, or to receive and process a corresponding electrical signal when the vibratable membrane is driven.

Preferably, in the case of the MEMS loudspeaker, the vertical sections of the membrane are directly driven by audio signals. In contrast to the combined driving separate membrane units and a plurality of valves according to US 2019/0116417 A1, the driving for sound generation is thus significantly simplified.

For the purpose of generating or receiving electrical signals, the control unit may preferably comprise a data processing unit.

Within the meaning of the invention, a data processing unit preferably refers to a unit which is adapted and configured for receiving, transmitting, storing and/or processing data, preferably with regard to driving the electrodes or reception of an electrical signal provided at the electrodes. The data processing unit preferably comprises an integrated circuit, for example also an application-specific integrated circuit, a processor, a processor chip, microprocessor or microcontroller for processing data, and optionally a data memory, a random access memory (RAM), a read-only memory (ROM) or also a flash memory for storing the data.

In preferred embodiments, the control unit is integrated on a printed circuit board or circuit board along with other components of the MEMS transducer (carrier, vibratable membrane). This means that there is preferably a seamless integration of the MEMS transducer with the electronic system which is necessary for the driving or detection. In addition to the control unit, other electronic components, such as a communication interface (preferably wireless, e.g. Bluetooth), an amplifier, a filter or a sensor system, can also be installed on one and the same printed circuit board.

Advantageously, a compact overall solution is achieved in which a MEMS transducer, preferably a MEMS loudspeaker or MEMS microphone, together with a desired electronic system can be provided in a confined space and preferably with low-cost CMOS processing suitable for mass production.

In a further preferred embodiment, the vibratable membrane held by the carrier is arranged in a front side of a housing which encloses a rear resonant volume. The sound emission of such a MEMS loudspeaker is thus preferably towards the open front side (sound port), whereby the sound is improved in particular for lower frequencies by the rear resonant volume.

In a further preferred embodiment, a ventilation opening is present in the housing to prevent acoustic short circuits and/or to support the sound. The ventilation opening is preferably small compared to the sound port and can, for example, have a maximum dimension of less than 100 μm, preferably less than 50 μm.

In another aspect, the invention relates to a manufacturing method for a MEMS transducer, preferably a MEMS loudspeaker or MEMS microphone, as described above, comprising the following steps:

- Etching of a substrate, preferably from a front side, to form a structure, preferably a meander structure
- Optional application of an etch stop
- Application of at least two layers, wherein at least a first layer comprises an actuator material and a second layer comprises a mechanical support material, or at least two layers comprise an actuator material
- Connection of the first and/or second layer to an electrode
- Etching, preferably from the rear side, and optional removal of the etch stop, such that a vibratable membrane, preferably in the form of a meander structure, is held by a carrier (4) formed by the substrate (8), the vibratable membrane (1) comprising at least two or more vertical sections (2) for generating or receiving pressure waves of the fluid in a vertical direction, which are formed parallel to the vertical direction and such that the two or more vertical sections can be induced to produce horizontal vibrations by driving the at least one electrode or such that an electrical signal can be generated at the at least one electrode when the two or more vertical sections are induced to vibrate horizontally.

The average person skilled in the art will recognize that technical features, definitions and advantages of preferred embodiments of the described MEMS transducer, preferably MEMS loudspeaker or MEMS microphone, also apply to the described manufacturing process and vice versa. Preferably, the described manufacturing method serves to provide a MEMS transducer having a folded vibratable membrane with a meander structure. Examples of preferred manufacturing steps are described in FIG. 2A-G, FIG. 8A-J or FIG. 9.

For example, one of the preferred materials mentioned above can be used as the substrate. During etching, a blank, for example a wafer, can be formed into the desired basic shape of the meander structure. In a next step, the layers for the vibratable membrane are preferably applied.

Application of at least one layer of conductive material preferably comprises, in addition to the application of one layer, the application of several layers and, in particular, of a layer system. A layer system comprises at least two layers applied in a planned manner relative to one another. The application of a layer or a layer system preferably serves to define the vibratable membrane comprising vertical sections which can be induced to produce horizontal vibrations.

Preferably, the deposition may be selected from the group comprising physical vapor deposition (PVD), in particular thermal evaporation, laser beam evaporation, arc evaporation, molecular beam epitaxy, sputtering, chemical vapor deposition (CVD) and/or atomic layer deposition (ALD). In particular, the deposition may include, for example, plating, e.g., in the case of a substrate made of polysilicon.

An etching and/or structuring can preferably be selected from the group comprising dry etching, wet chemical etching and/or plasma etching, in particular reactive ion etching, reactive ion deep etching (Bosch process).

In a preferred embodiment, the etching of a substrate, preferably from a front side, to form a structuring is characterized in that the substrate has a crystal structure and a plurality of trenches are made by etching along a lattice vector of the crystal structure. Preferably, the trenches are defined as parallel slits from the front side of the substrate. After application of the functional layers and appropriate backside processing, a vibratable membrane is formed as bellows with a meander structure in cross-section (see FIGS. 2 and 8, among others).

Preferred etching along the orientation of a crystal substrate can advantageously obtain smooth quasi-crystalline trenches with large depth of more than 200 μm, 300 μm, 400 μm 500 μm or more with high-precision orientation and negligible roughness.

It is also advantageous that the surface normal of the side faces of the trenches is also aligned with the crystal structure, preferably an orthogonal lattice vector.

When applying a layer of an actuator material, preferably a piezoelectric material, to such a structured substrate, the orientation of the actuator material can also be quasi-crystalline. In particular, piezoelectric materials such as AlN, AlScN or PZT advantageously exhibit columnar growth on the sidewalls of the trenches oriented in this way, which can ensure that the piezoelectric layer has a particularly precise c-axis orientation that is perpendicular to the surface of the vertical sections of the resulting membrane.

The formation of horizontal vibrations by the transverse piezoelectric effect can therefore be particularly effective and precise and can provide for an improved sound in the case of a MEMS loudspeaker or detection capability in the case of a MEMS microphone.

In a preferred embodiment, the etching of a substrate, preferably from a front side, to form a structuring, preferably a meander structure is characterized in that the substrate has a crystal structure and a plurality of trenches along a lattice vector is achieved at least in part by a wet chemical etching, preferably crystal orientation dependent anisotropic etching is performed.

Preferably, an etching agent is used for this purpose which has a significantly different etch rate with respect to the crystal orientation of the substrate in two orthogonal crystal orientations. For example, an etch rate can be higher by a factor of 50, 10, 150, 200 or more for the selected substrate in a first crystal orientation than in a second crystal orientation orthogonal thereto.

Preferably, the substrate is oriented in such a way that the first crystal orientation for which there is an increased etch rate is aligned with the surface normal of the substrate surface. An etch mask can be used to define areas on the substrate surface that are not to be etched. Preferably, the etch mask can define a frame in which slots or strips for forming the trenches remain free. Areas remaining between the parallel trenches to be formed can serve as substrate for the horizontal sections of the membrane.

The anisotropic wet chemical etching is followed by preferential etching perpendicular to the substrate surface to form deep vertical trenches. Etching in an orthogonal (horizontal) direction is thus reduced. The greater the anisotropy factor of the crystal orientation-dependent etching, the less pronounce an undercut will be.

Particularly good results can be achieved, for example, using potassium hydroxide (KOH) as an etching agent for a silicon crystal substrate. For example, potassium hydroxide exhibits a clear directional preference for etching along a <110> orientation of a silicon crystal versus a <111> orientation. As shown in Sato et al. 1988, the etch rate for KOH on a silicon monocrystal in a <110> direction can be 1.455 μm/min, a factor of 291 higher than in an orthogonal <111> orientation (etch rate 0.005 μm/min).

FIG. 9 illustrates how appropriate alignment of a silicon crystal can reliably produce nearly perfectly smooth and deep trenches whose side faces are crystal oriented to ensure c-axis oriented growth of piezoelectric materials.

The person skilled in the art understands that alternative crystal orientation-dependent etching agents, such as tetramethylammonium hydroxide (TMAH), can be equally used (see e.g. Seidel et al 1990).

Advantageously, the process is not only suitable for upscaling for mass production. In addition, meander-shaped vibratable membranes that can be produced in this way are also characterized by a particularly precise alignment of the vertical sections, which leads to improved vibration behavior and thus sound generation or detection.

If further structuring of the vibratable membrane is desired, this can be carried out, for example, by further etching processes. Likewise, additional material can be deposited or doping can be carried out by usual processes.

For connecting the layers, suitable material such as copper, gold and/or platinum can additionally be deposited by common processes. Preferably, physical vapor deposition (PVD), chemical vapor deposition (CVD) or electrochemical deposition can be used for this purpose.

By means of these process steps, a finely structured vibratable membrane with a desired definition of vertical and horizontal sections can be provided, which is preferably suspended between two side regions of a stable carrier and has dimensions in the micrometer range. The manufacturing steps belong to standard process steps of semiconductor processing, such that they are proven and furthermore suitable for mass production.

In a further aspect, the invention thus also relates to a MEMS transducer manufacturable by the manufacturing process as described above.

The person skilled in the art recognizes that special features of the manufacturing steps, such as a crystal orientation-dependent etching to form deep trenches with quasi-crystalline smooth surfaces, are directly transferred to structural features of the MEMS transducer. In the case of a quasi-crystalline smooth surface of the side surfaces of the trenches, a vibratable membrane with a plurality of vertical sections in meander shape can be formed in a particularly precise manner, as explained above. Also a c-axis orientation of an actuator material, preferably a piezoelectric material, can follow directly from the application of the preferred manufacturing steps.

In another aspect, the invention relates to a manufacturing method for a MEMS transducer as described above, comprising the following steps:

- Provision of a plurality of individual piezoceramic elements comprising a sacrificial layer, a layer of conductive material, and a layer of piezoelectric material
- Definition of holes for interlayer connection in the piezoceramic elements and metal filling
- Stacking of the piezoceramic elements and optional dicing so that a stack of piezoceramic elements is obtained which is connected by metal bridges
- Removal of the sacrificial layer and insertion of the stack of piezoceramic elements into a carrier, whereby the piezoceramic elements are connected to one electrode each, such that a vibratable membrane, preferably in the form of a lamellar structure, is held by a carrier formed by the substrate, the vibratable membrane comprising at least two or more vertical sections for generating or receiving pressure waves of the fluid in a vertical direction, which are formed parallel to the vertical direction, and such that the two or more vertical sections can be induced to produce horizontal vibrations by driving the at least one electrode, or such that an electrical signal can be generated at the at least one electrode when the two or more vertical sections are induced to vibrate horizontally.

The average person skilled in the art will recognize that technical features, definitions and advantages of preferred embodiments of the described MEMS transducer, preferably a MEMS loudspeaker or MEMS microphone, also apply to the described manufacturing process, and vice versa. Preferably, the described manufacturing method is for providing a MEMS transducer having a vibratable membrane with a lamellar structure, wherein the lamellae are mechanical bimorphs and are connected by metal bridges. Examples of preferred manufacturing steps are illustrated in FIG. 10A-F and FIG. 11.

In the alternative manufacturing process, several individual piezoceramic elements can be advantageously used to obtain, by means of a definition of holes, metal filling and stacking and dicing, a vibratable membrane with lamellae as vertical sections connected by metal bridges.

Piezoceramics are preferably ceramic materials that exhibit charge separation under the effect of deformation by an external force or undergo a change in shape when an electrical voltage is applied. The piezoceramic element preferably comprises a piezoelectric layer as well as a layer of a mechanical support material, as described above, and furthermore a sacrificial layer.

The sacrificial layer is used to process and provide the metal bridges and will not itself be part of the vibratable membrane.

Preferably, the sacrificial layer can be, for example, a photoresist. These materials change their solubility when irradiated with light, in particular UV light. In particular, it may be a so-called positive resist, the solubility of which increases as a result of UV irradiation. This allows the sacrificial layer to be removed in a targeted manner after metal filling to provide the metal bridges.

In another aspect, the invention relates to a manufacturing method for a MEMS transducer comprising the following steps:

- Provision of a plurality of individual piezoceramic elements comprising a layer of mechanical support material which is electrically conductive and a layer of piezoelectric material
- Provision of an upper and lower frame with recesses for the plurality of individual piezoceramic elements
- Securing the piezoceramic elements in the recesses of the upper and lower frame, preferably by means of an adhesive
- Application of at least one continuous electrically conductive layer for connecting the piezoceramic elements by means of at least one electrode such that a vibratable membrane, preferably in the form of a lamellar structure, is held by a carrier which is formed by the upper and lower frame and wherein the vibratable membrane for generating or receiving pressure waves of the fluid in a vertical direction comprises at least two or more vertical sections which are formed parallel to the vertical direction, such that by driving the at least one electrode the two or more vertical sections can be induced to produce horizontal vibrations or such that when the two or more vertical sections are induced to vibrate horizontally an electrical signal can be generated at the at least one electrode.

The preferred embodiment is illustrated in FIG. 12. Advantageously, in the embodiment, a structured connection is dispensed with. Instead, a connection is made by means of a continuous conductive surface from a front side and/or a rear side of the MEMS transducer.

In a preferred embodiment, the upper and lower frames are formed from an electrically non-conductive material, for example a polymer. Preferably, a 3D printing process can be used to form the frames.

For connecting the individual lamellae or piezoceramic elements, a continuous layer of conductive material, preferably metal, is preferably applied from the front (front electrode) or from the rear (backside electrode). The application can be carried out, for example, by means of a sputtering process.

The average person skilled in the art will recognize that technical features, definitions and advantages of preferred embodiments of the described MEMS transducer, preferably a MEMS loudspeaker or MEMS microphone, also apply to the described manufacturing process, and vice versa. Preferably, the described manufacturing method serves to provide a MEMS transducer having a vibratable membrane with a lamellar structure, wherein the lamellae are mechanical bimorphs and are connected by a continuous layer of a conductive material, preferably metal.

The invention will be explained below with reference to further figures and examples. The examples and figures serve to illustrate preferred embodiments of the invention without limiting them.

DETAILED DESCRIPTION

Figure 1:
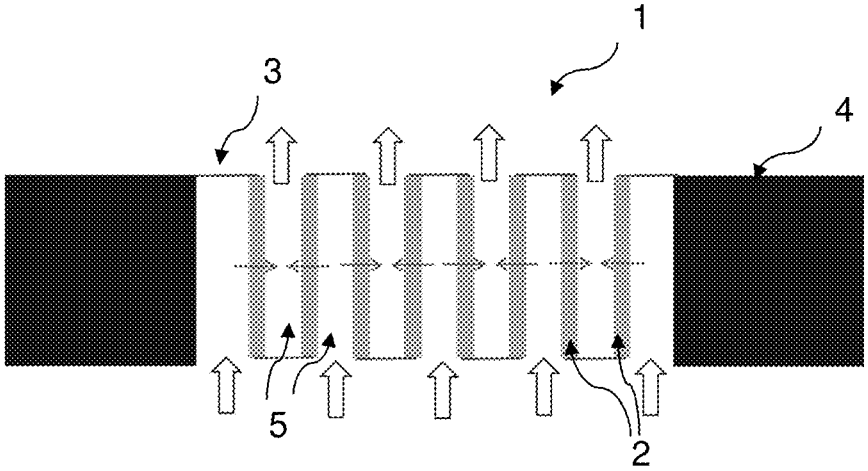
FIG. 1 Diagram of a cross-section of a preferred embodiment of a MEMS loudspeaker according to the invention, (A): idle and (B): during driving.
Figure 1:
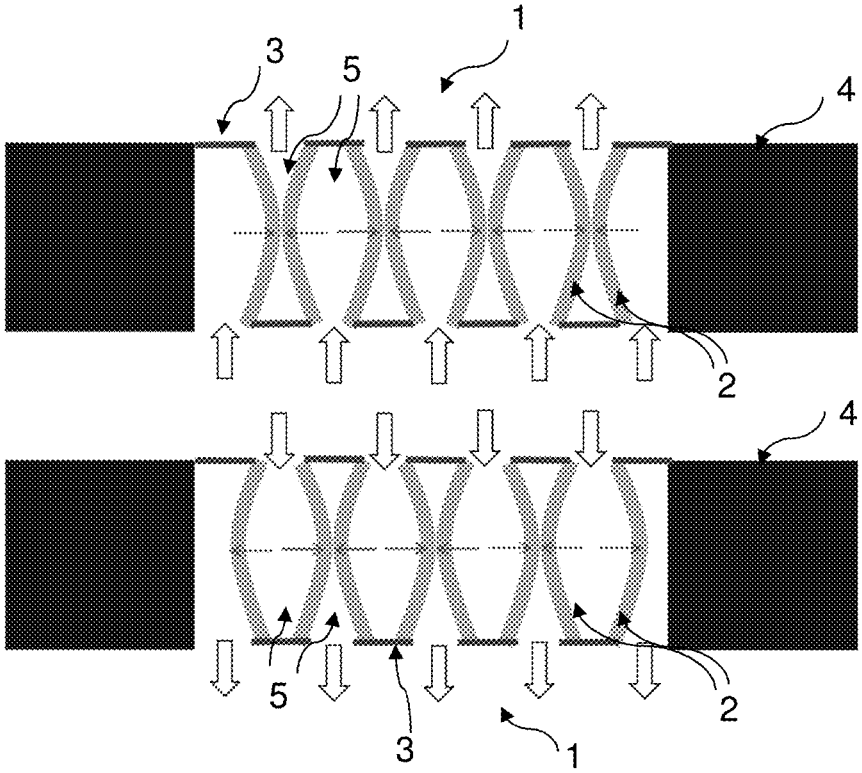

FIG. 1 illustrates a preferred embodiment of a MEMS loudspeaker according to the invention. FIG. 1 (A) shows an idle state, while FIG. 1, (B) illustrates two phases during driving the MEMS loudspeaker.

The MEMS loudspeaker comprises a vibratable membrane 1 for generating sound waves in a vertical direction of emission, the vibratable membrane 1 being held in a horizontal position by a carrier 4. In cross-section, the vibratable membrane 1 has a meander structure with horizontal 3 and vertical sections 2. The vertical sections are formed parallel to the direction of emission and exhibit at least one actuator layer, for example a layer made of a piezoelectric material. Connection of the vibratable membrane 1 and the actuator layer is preferably achieved by means of electrodes at the ends. For this purpose, for example, an electrode pad (not shown) may be located on the carrier 4.

Preferably, the vertical sections are mechanical bimorphs which can be induced to produce horizontal vibrations as a result of appropriate driving. For this purpose, the vertical sections 2 may comprise, for example, a first layer of an actuator material and a second layer of a mechanical support material. By driving the actuator layer, a stress gradient and consequently a curvature or vibration can be generated. Likewise, it may also be preferred that the vertical sections 2 comprise two actuator layers which are driven in opposite directions in order to cause a curvature of the vertical sections 2 as a result of a corresponding relative change in shape.

FIG. 1, (B) illustrates by way of example two phases during driving. Advantageously, due to the plurality of vertical sections 2 of the vibratable membrane 1, an increased total volume can be moved in the vertical direction of emission with small horizontal movements (curvature) of a few micrometers, and thus used for sound generation. The driving allows here a particularly efficient implementation, since during one phase almost the entire air volume between the vertical sections can be moved up or down along the direction of emission.

Figure 2:
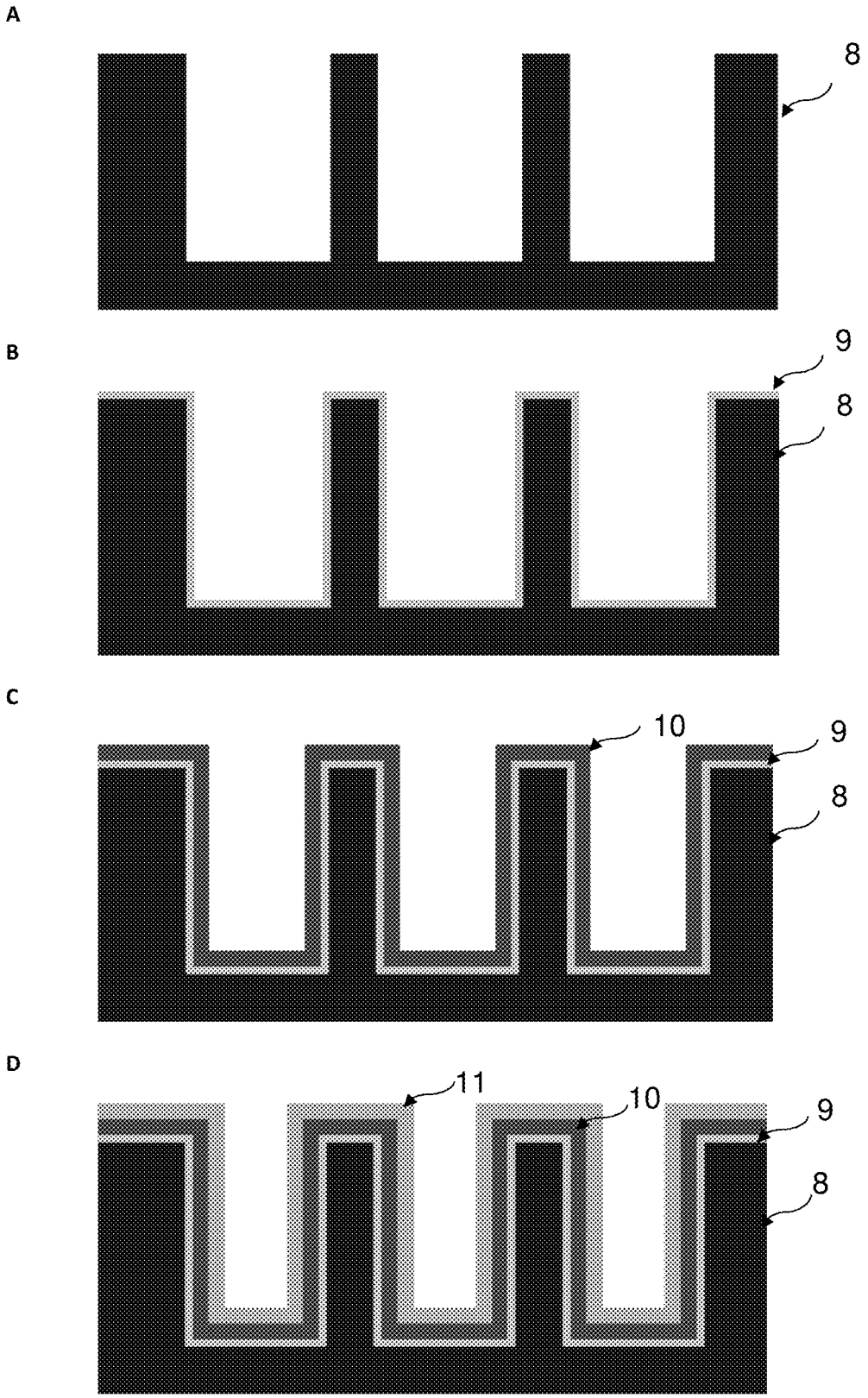
FIG. 2 Diagram of a preferred manufacturing method for a MEMS loudspeaker with a vibratable membrane that exhibits a meander shape in cross-section. (A) An etching of the substrate 8 from a top or front side to form a structuring. (B) a layer of an etch stop 9 is applied, which may be TEOS or PECVD, for example. (C) A layer of mechanical support material 10 and a layer of actuator material 11 are applied to the etch stop 9. (D) A piezoelectric material can be used for the actuator material 11. (E) shows the preferred application of a full-surface top electrode as a layer of a conductive material 12. (F) End-side connection can be achieved, for example, by means of an electrode pad 13. (G) Further etching of the substrate 8 from the bottom side and removal of the etch stop.
Figure 2:
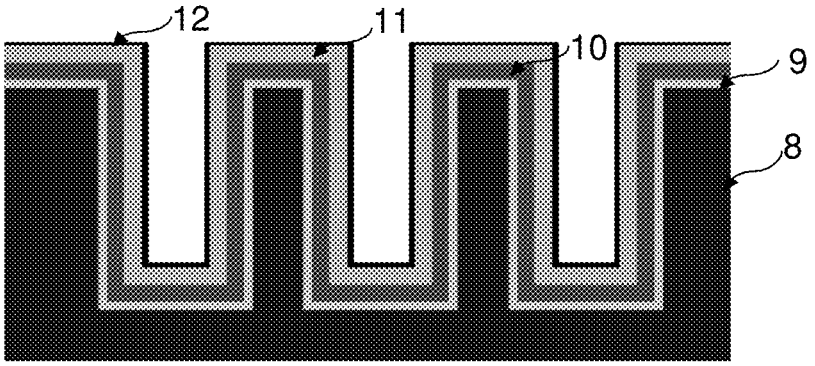
Figure 2:
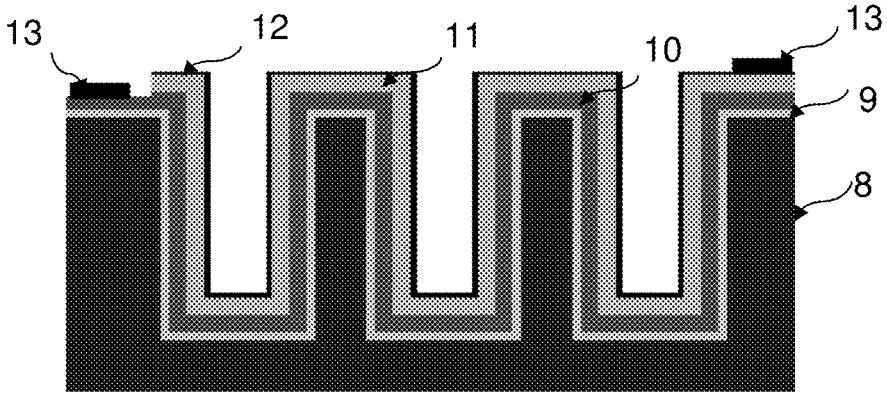
Figure 2:
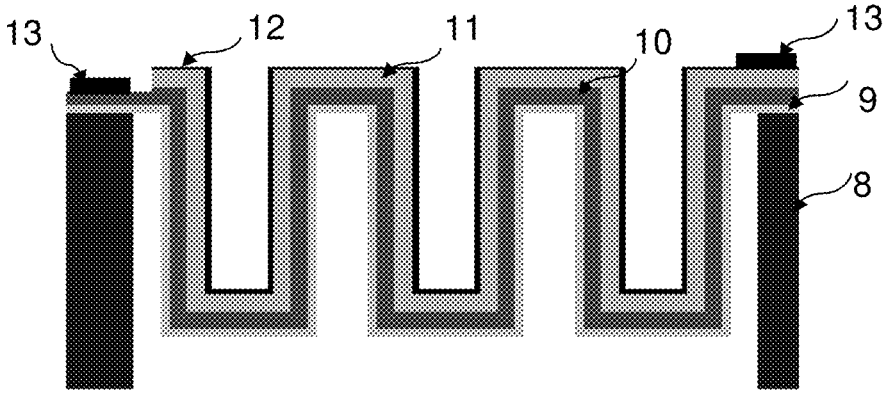

FIG. 2 schematically shows a preferred manufacturing method for providing a MEMS loudspeaker with a vibratable membrane 1 which has a meander shape in cross-section. A vibratable membrane with a meander shape in cross-section may also preferably be referred to as a folded membrane or bellows.

FIG. 2, (A) shows an etching of the substrate 8 from a top or front side to form a structuring. In the process step, parallel deep trenches are etched into the substrate 8. The formed structure represents bellows or, in cross-section, a meander.

Subsequently, a layer of an etch stop 9 (FIG. 2, (B)) is applied, which may be TEOS or PECVD, for example. A layer of mechanical support material 10 (FIG. 2, (C)) and a layer of actuator material 11 are applied to the etch stop 9. The mechanical support material 10 can be, for example, doped polysilicon, while a piezoelectric material can be used for the actuator material 11. As layer thicknesses, 1 μm may be preferred, for example. Preferably, the piezoelectric material may have a C-axis orientation perpendicular to the surface such that a transverse piezoelectric effect is used. Other orientations and, for example, the utilization of a longitudinal effect may also be preferred.

FIG. 2, (E) shows the preferred application of a full-surface top electrode as a layer of a conductive material 12. End-side connection can be achieved, for example, by means of an electrode pad 13 (FIG. 2, (F)).

FIGS. 2, (F) and 2, (G) illustrate further etching of the substrate 8 from the rear and bottom sides, respectively, and removal of the etch stop.

The manufacturing steps 2, (A)-(G) thus result in a vibratable membrane 1 which exhibits a meander structure in cross section. Advantageously, a continuous actuator layer 11 and the provision of end-side connections 13 allow efficient driving the vertical sections 2 to produce horizontal vibrations (see FIG. 1). As can be seen in FIG. 2, (G), driving is preferably achieved by means of two electrodes, such the actuator layer 12 is preferably connected both from a front side (top electrode, conductive layer 12) and from a rear side (bottom electrode, via conductive mechanical support material 10) (see FIG. 6, (A)).

Figure 3:
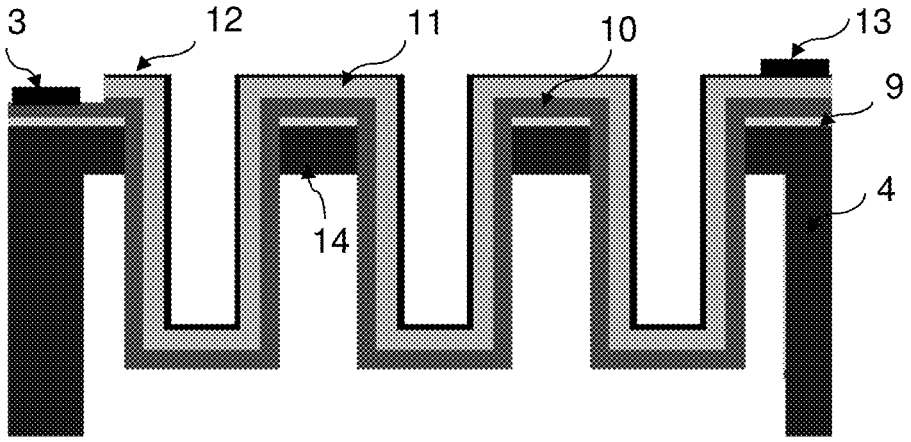
FIG. 3 Diagram of a first preferred embodiment of a MEMS loudspeaker with a vibratable membrane in meander shape, the horizontal sections of which are supported by retaining structures.
Figure 4:
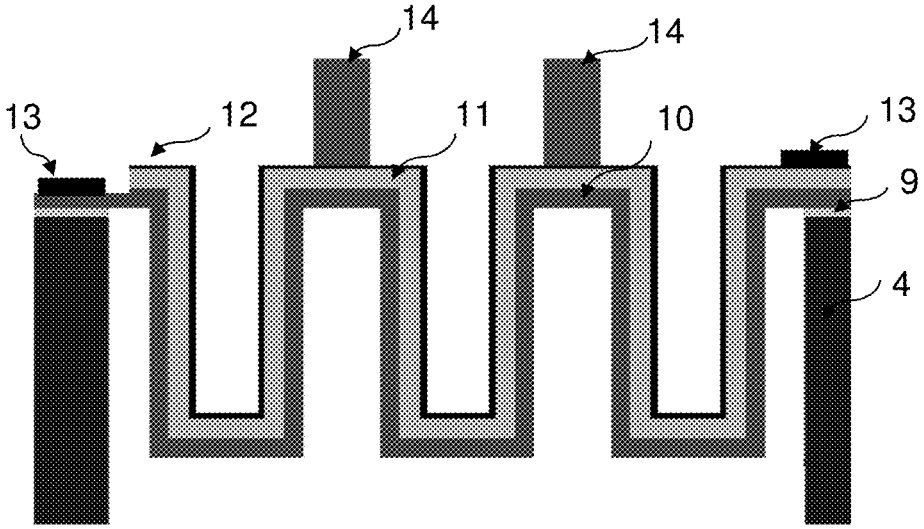
FIG. 4. Diagram of a second preferred embodiment of a MEMS loudspeaker with a vibratable membrane in meander shape, the horizontal sections of which are supported by retaining structures.

Retaining structures 14 may be provided to stabilize the membrane 1 suspended between the side walls of the carrier 4. As shown in FIGS. 3 and 4, these can preferably support horizontal sections 3 of the vibratable membrane 1. Advantageously, the horizontal sections 3 are mechanically neutral (see FIG. 1, (B)), such that no undesirable stresses are induced between the membrane 1 and the retaining structure 14 or carrier 4 during driving.

Figure 5:
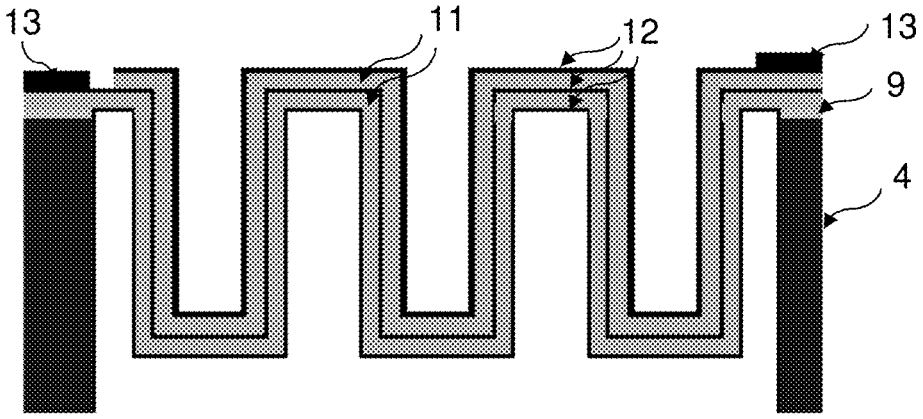
FIG. 5 Diagram of a preferred embodiment of a MEMS loudspeaker with two actuator layers separated by a middle layer made of a conductive material.

FIG. 5 illustrates a preferred alternative embodiment of a MEMS loudspeaker wherein the vibratable membrane 1 comprises two actuator layers separated by a middle layer of a conductive material 12, preferably metal. The middle layer is connected to a first end-side electrode pad 13, while in the embodiment shown the upper actuator layer 11 is connected to a second end-side electrode pad 13 via a further layer of conductive material 12.

Figure 6:
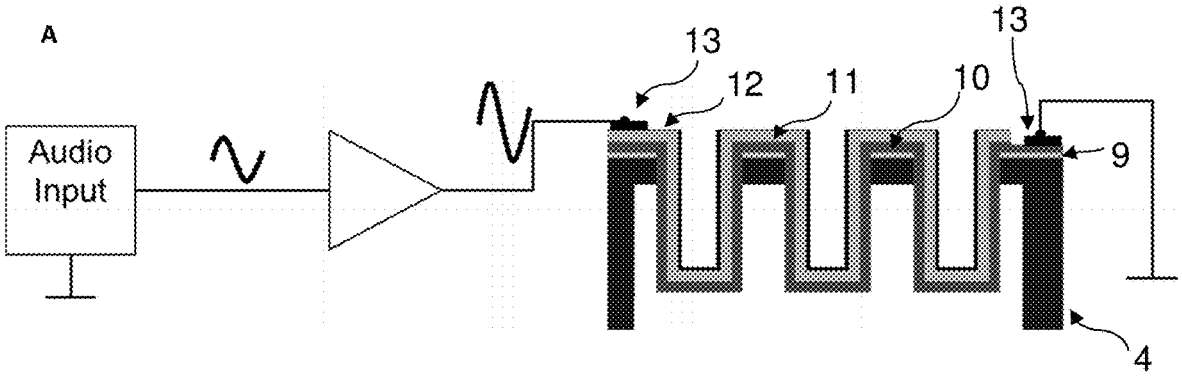
FIG. 6 Diagram of preferred drive systems for operating the MEMS loudspeakers. (A) A preferred drive system for a MEMS loudspeaker with an actuator layer 11 and a passive mechanical support layer 10. (B) a preferred drive system for a MEMS loudspeaker with two actuator layers 11 separated by a middle layer of a conductive material 12, preferably metal.
Figure 6:
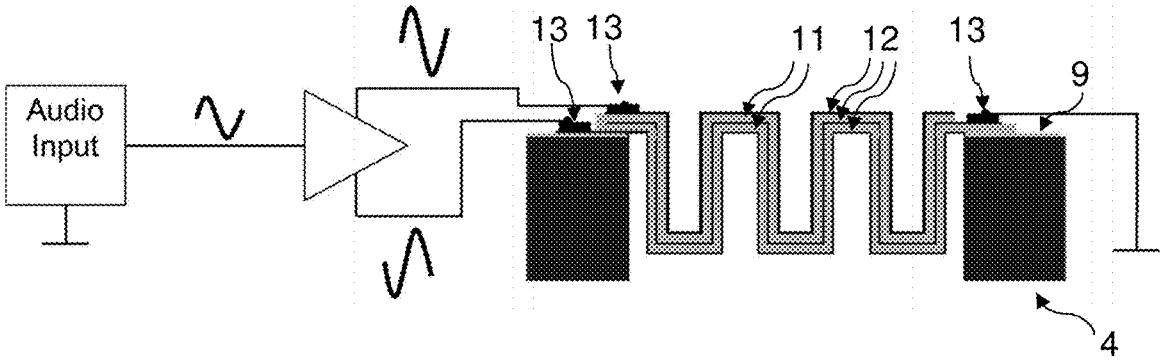

FIG. 6 illustrates preferred drive systems for operating the MEMS loudspeakers described.

FIG. 6, (A) shows a preferred drive system for a MEMS loudspeaker with an actuator layer 11 and a passive mechanical support layer 10. Preferably, the driving is performed by means of two end-side electrode pads 13, such that the horizontal vibrations can be generated by a change in shape of the actuator material relative to the mechanical support material. The actuator layer 11 is preferably connected both from a front side (top electrode 13, conductive layer 10) and from a rear side (bottom electrode 13, conductive mechanical support material 10). For example, an AC voltage as an audio input signal can be applied to the front-side electrode pad 13 (left), while the rear-side electrode pad 13 (right) is grounded.

FIG. 6, (B) shows a preferred drive system for a MEMS loudspeaker with two actuator layers 11 separated by a middle layer of a conductive material 12, preferably metal.

An upper actuator layer 11 is preferably driven from a front side (top electrode 13 and upper conductive layer 12) and the middle conductive layer 12. A lower actuator layer 11 is preferably driven from a rear side (bottom electrode 13 and lower conductive layer 12) and the middle conductive layer 12. In the illustrated embodiment, an AC voltage can be applied as an audio input signal to, for example, the electrode pads 13 (left) used for the top and bottom, while the middle layer 12 is grounded via another electrode pad 13 (right).

Figure 7:
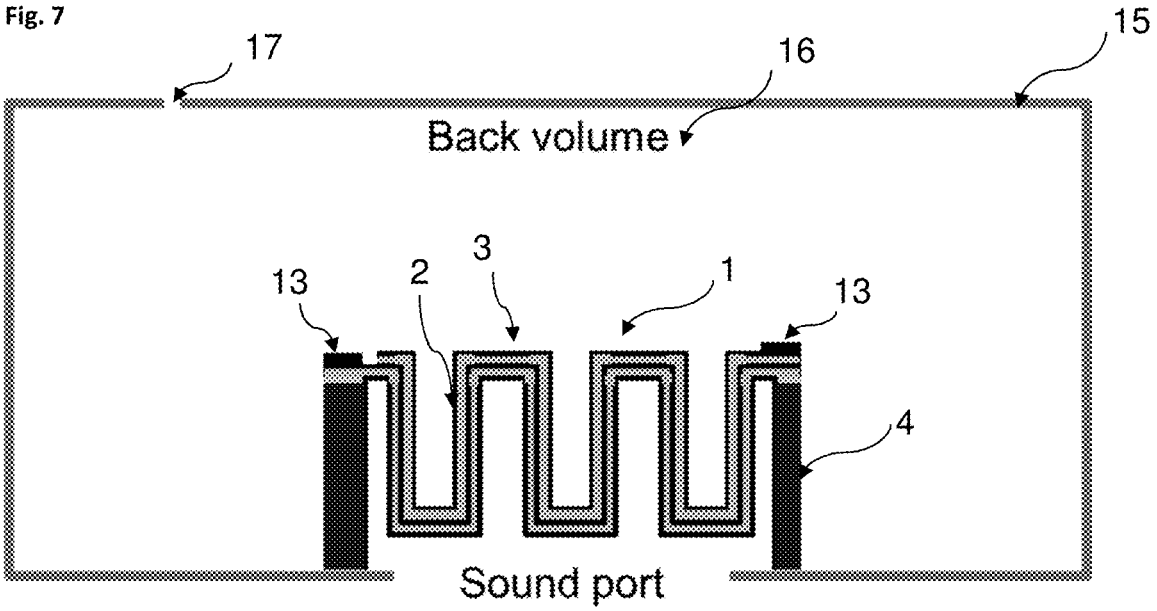
FIG. 7 Diagram of a preferred integration of a MEMS loudspeaker in the front of a housing with rear resonant volume.

FIG. 7 shows an example of a preferred integration of a MEMS loudspeaker according to the invention in a housing 15. Preferably, the vibratable membrane 1 held by the carrier 4 is arranged in a front side of a housing (sound port). The housing also encloses a rear resonant volume (back volume 16). A ventilation opening 17 can be provided to prevent acoustic short circuits or to support the sound.

Figure 8:
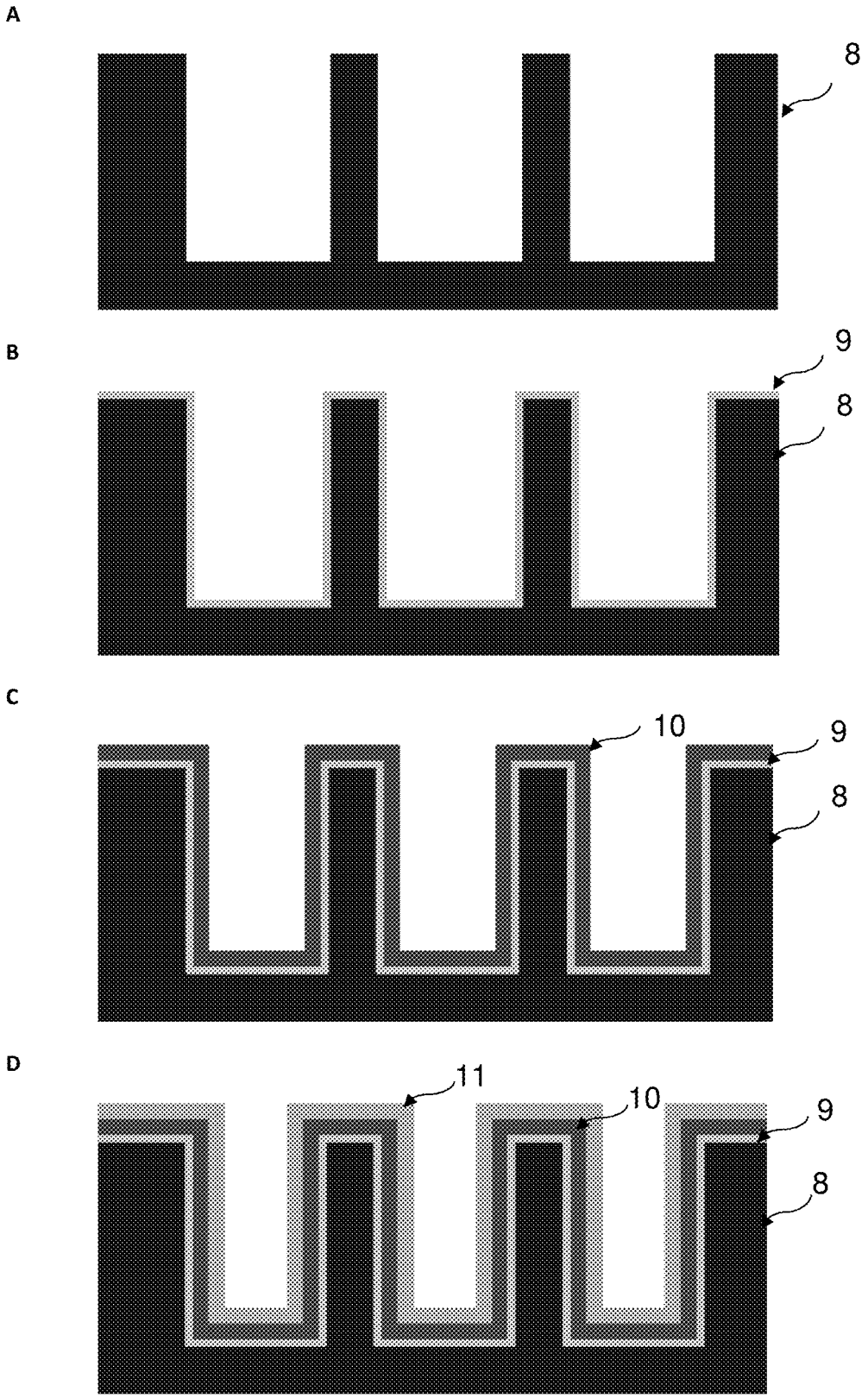
FIG. 8 Diagram of a preferred manufacturing method for a MEMS loudspeaker with a vibratable membrane having a meander shape in cross-section, with only the vertical sections having a layer of actuator material. (A) An etching of the substrate 8 from a top or front side to form a structuring. (B) A layer of an etch stop 9 is applied, which may be TEOS or PECVD, for example. (C) A layer of a mechanical support material 10 is applied to the etch stop 9. (D) An actuator material 11 is applied to the etch stop 9. (E) The actuator layer 11 is not connected as a continuous layer to an upper conductive layer. (F) A spacer etching of the actuator layer 11 is performed in the horizontal sections of the membrane, such that only the vertical sections of the membrane still have a layer of an actuator material 11. (G) A continuous dielectric layer 18 is then preferably applied to prevent a short circuit between the top and bottom electrodes which are to be applied later. (H) A continuous conductive layer as top electrode 12 allows front-side connection. (I) further etching of substrate 8 from the backside and optionally applying a continuous conductive layer 12 as a backside electrode. (J) further etching of substrate 8 from the underside and optionally applying a continuous conductive layer 12 as a backside electrode.
Figure 8:
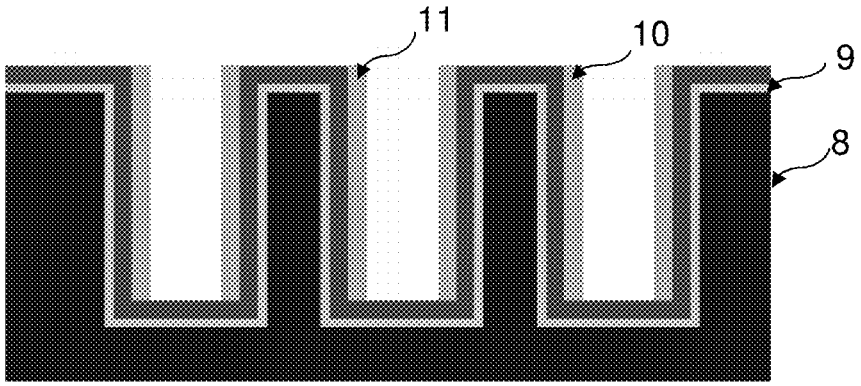
Figure 8:
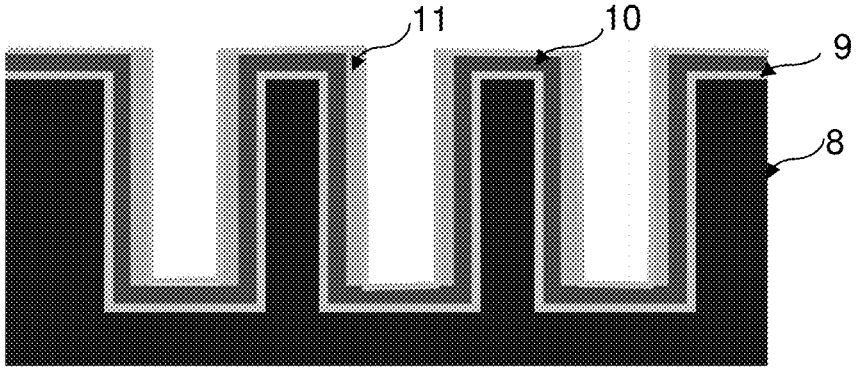
Figure 8:
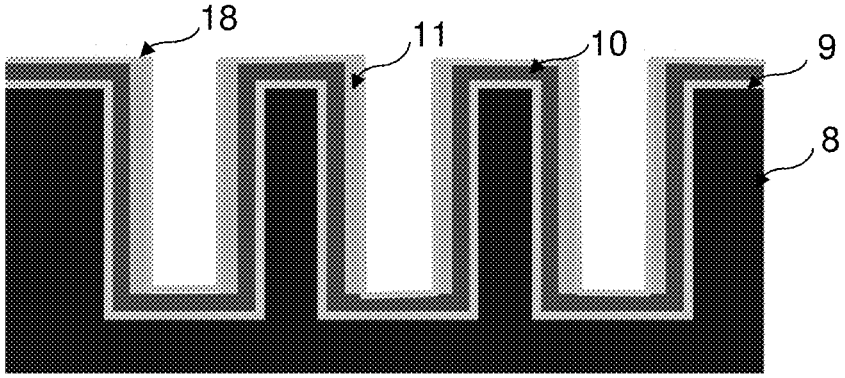
Figure 8:
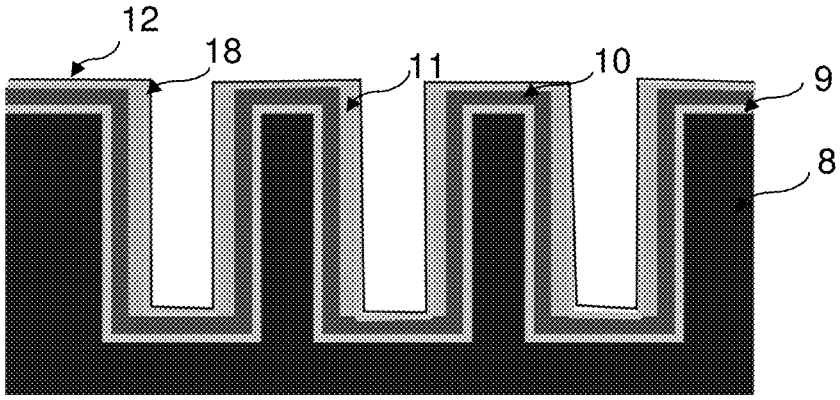
Figure 8:
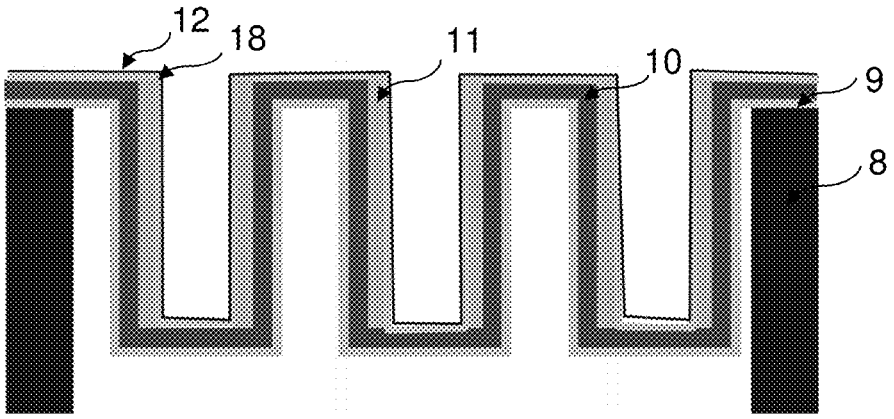
Figure 8:
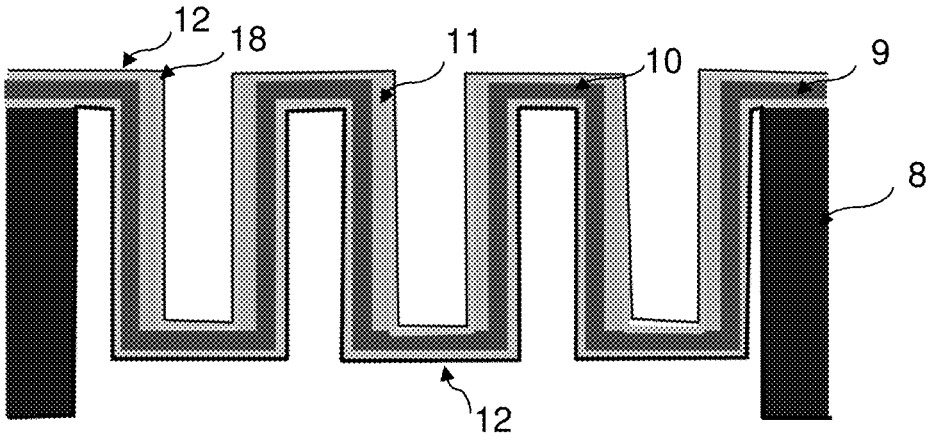

FIG. 8 illustrates an alternative manufacturing method for providing a MEMS loudspeaker with a vibratable membrane 1 according to the invention. The process steps shown in FIG. 8, (A)-(D) are analogous to FIG. 2.

FIG. 8, (A) shows an etching of the substrate 8 from a top or front side to form a structuring, preferably a meander structure. In this process step, parallel deep trenches are etched into the substrate 8. The formed structure represents bellows or, in cross-section, a meander.

Subsequently, a layer of an etch stop 9 (FIG. 2, (B)) is applied, which may be TEOS or PECVD, for example. A layer of a mechanical support material 10 (FIG. 2, (C)) and an actuator material 11 is applied to the etch stop 9. The mechanical support material 10 may, for example, be doped polysilicon, while a piezoelectric material is preferably used for the actuator material 12.

In contrast to the embodiment shown in FIG. 2, the actuator layer 11 is not connected as a continuous layer to an upper conductive layer. Instead, spacer etching (FIG. 8, (F)) of the actuator layer 11 is performed in the horizontal sections of the membrane, such that only the vertical sections of the membrane still have a layer of an actuator material 11.

A continuous dielectric layer 18 is then preferably applied to prevent a short circuit between the top and bottom electrodes which are to be applied later (FIG. 8, (G)). A continuous conductive layer as top electrode 12 allows front-side connection (FIG. 8, (H)).

FIGS. 8I and 8J illustrate further etching of substrate 8 from the backside or underside and optionally applying a continuous conductive layer 12 as a backside electrode.

Figure 9:
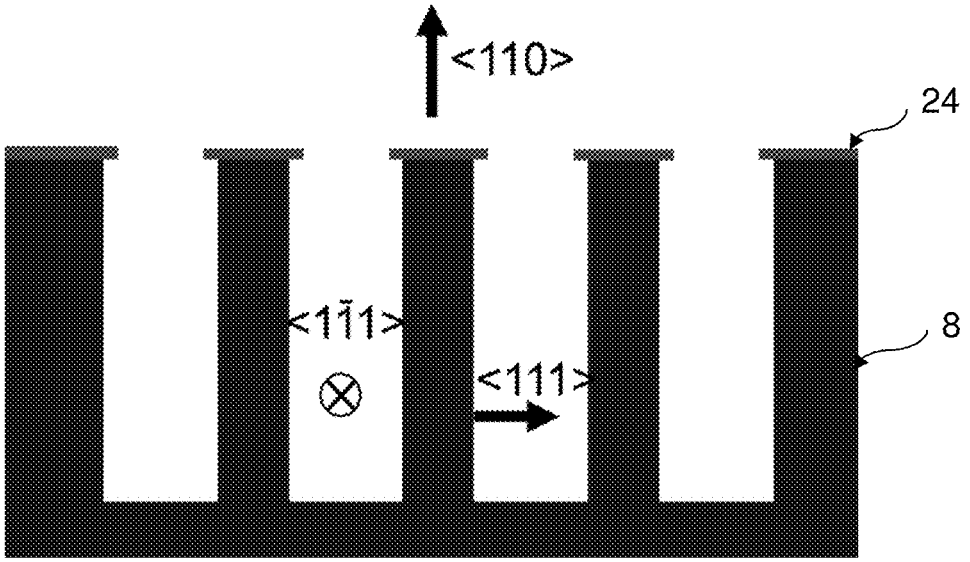
FIG. 9 Diagram of a preferred structuring of a substrate in crystal form to form deep trenches by means of a crystal orientation-dependent etching process.

FIG. 9 illustrates a preferred way of providing a structured substrate 8. In a manner similar to the process step shown in FIG. 8, (A), parallel deep trenches are etched into the substrate 8. The formed structure represents bellows or, in cross-section, a meander, onto which a vibratable membrane can be applied in meander form.

The preferred provision of the structured substrate 8 in FIG. 9 is characterized by the utilization of a crystal structure of the substrate 8, wherein the trenches are formed along a lattice vector of the crystal structure.

In this way, particularly smooth, quasi-crystalline trenches with a large depth of more than 200 μm, 400 μm or more can be obtained with high-precision orientation. It is also advantageous that the surface normal of the side surfaces of the trenches is aligned with a lattice vector which is orthogonal to the lattice vector in whose direction the etching process has taken place.

For example, if silicon is used as a substrate, the silicon substrate 8 may be present as shown in FIG. 9, preferably aligned with a surface orientation of the Miller indices <110>. Preferably, therefore, the lattice vector of the crystal structure <110> is perpendicular to the surface of the still unstructured substrate. By means of an etch mask 24, for example an $SiO_2$ hard mask, horizontal areas or stripes on the substrate surface can be defined which are not to be etched.

Smooth and precisely oriented trenches are obtained by anisotropic etching with a preferred direction along the <110> orientation of the silicon crystal, versus a <111> orientation. For this purpose, wet chemical processes can be advantageously used, which are suitable for mass production in a batch process. For example, potassium hydroxide exhibits a clear directional preference for etching along the <110> versus a <111> crystal orientation. As shown in Sato et al. 1988, the etch rate for KOH on a silicon monocrystal in <110> is 1.455 μm/min, while the etch rate in the <111> orientation is only 0.005 μm/min. Due to the anisotropic etch rates, deep trenches with a low underetch can be obtained using the wet chemical process.

For example, to form 400 μm deep trenches, KOH can be applied to a <110> oriented silicon substrate for 275 min. Due to the etch rate being reduced by a factor of 291 in the orthogonal <111> orientation, only 1.37 μm of underetching will occur during the period. Even a variation in the local strength of the underetching process, will result in orientation variations well below 1° with respect to the large depth of the trenches of 400 μm. Instead, with a high degree of accuracy, the process can achieve almost perfectly vertical deep trenches, characterized by a smooth, quasi-crystalline orientation.

As a further advantage, the thus obtained sidewalls of the trenches on which the vertical sections of the membrane are formed are in a crystal orientation (here: <111>). This circumstance facilitates a columnar growth of piezoelectric materials, such as AlN or PZT: This can ensure in a particularly precise manner that the piezoelectric material has a c-axis orientation perpendicular to the surface of the vertical sections, such that a transverse piezoelectric effect can be used for the formation of the horizontal vibrations.

Figure 10:
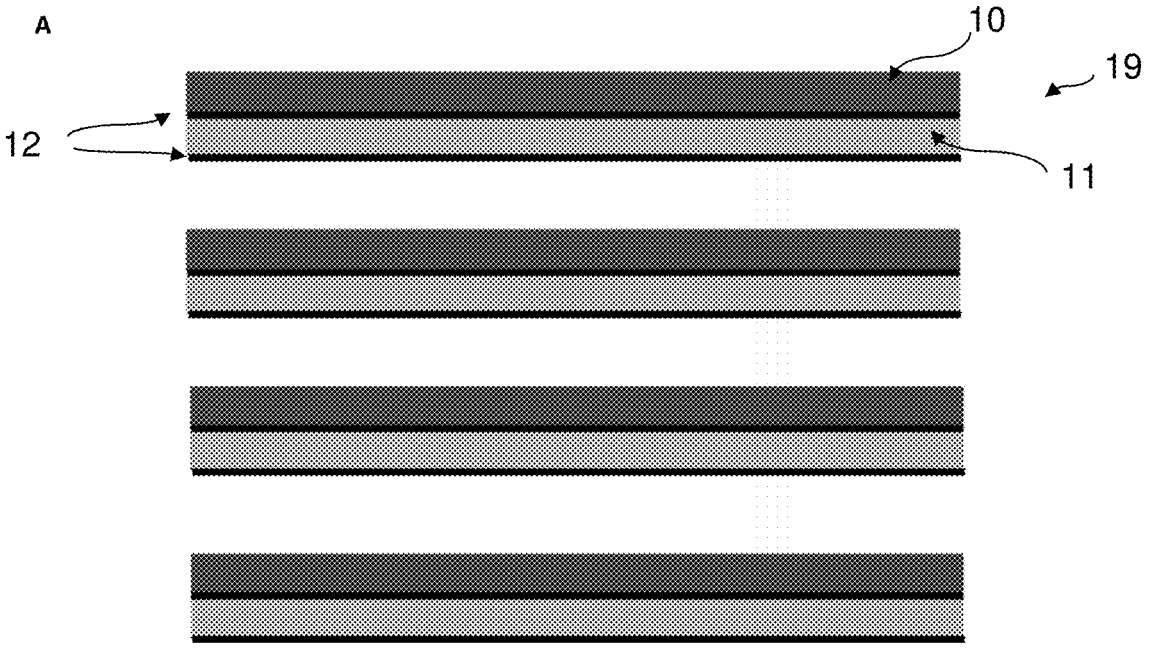
FIG. 10 Diagram of a preferred manufacturing method for a MEMS loudspeaker with a vibratable membrane based on individual piezoceramic elements. (A) a plurality of individual piezoceramic elements 19 are provided comprising a layer of mechanical support material 10 (e.g. doped polysilicon) and a layer of piezoelectric material 11. (B) A sacrificial layer 20 is further applied. (C) holes are defined for interlayer connection and metal filling 21. (D) The piezoceramic elements 19 are stacked. (E) Two or more stacks of piezoceramic elements 19 are obtained, which are connected by metal bridges 21. (F) The piezoceramic elements 19 are cut (dicing 22). (G) The first and last piezoceramic elements each being connected to an electrode 13.
Figure 10:
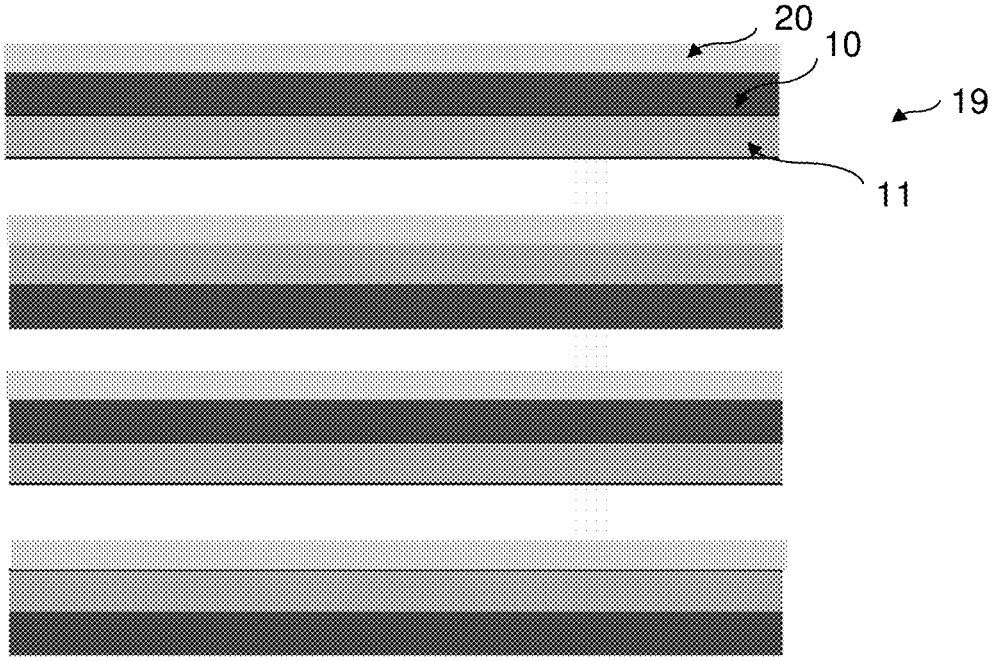
Figure 10:
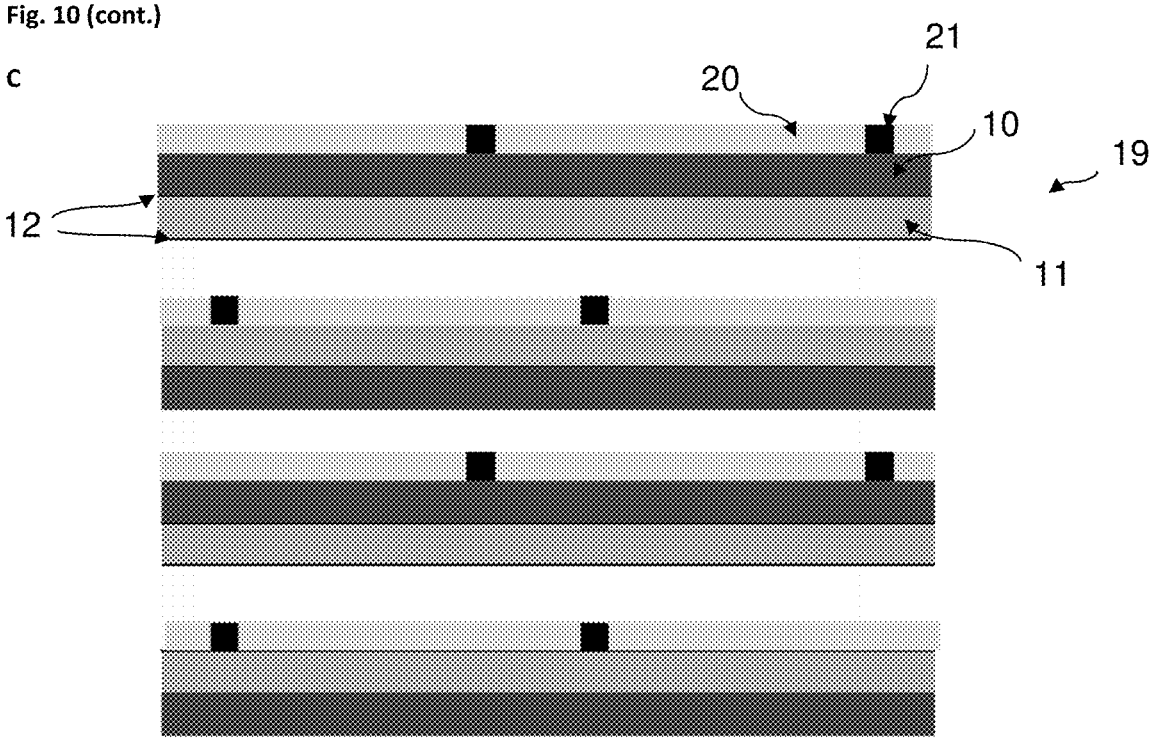
Figure 10:
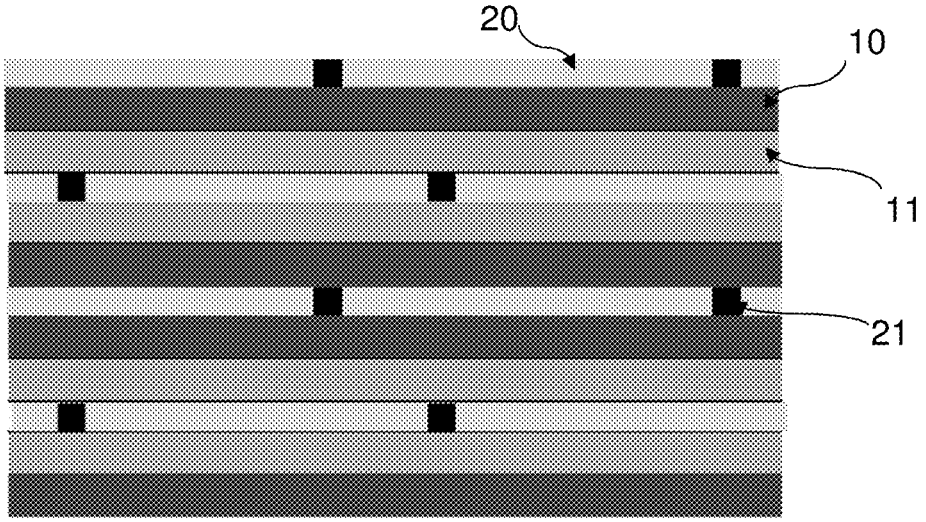
Figure 10:
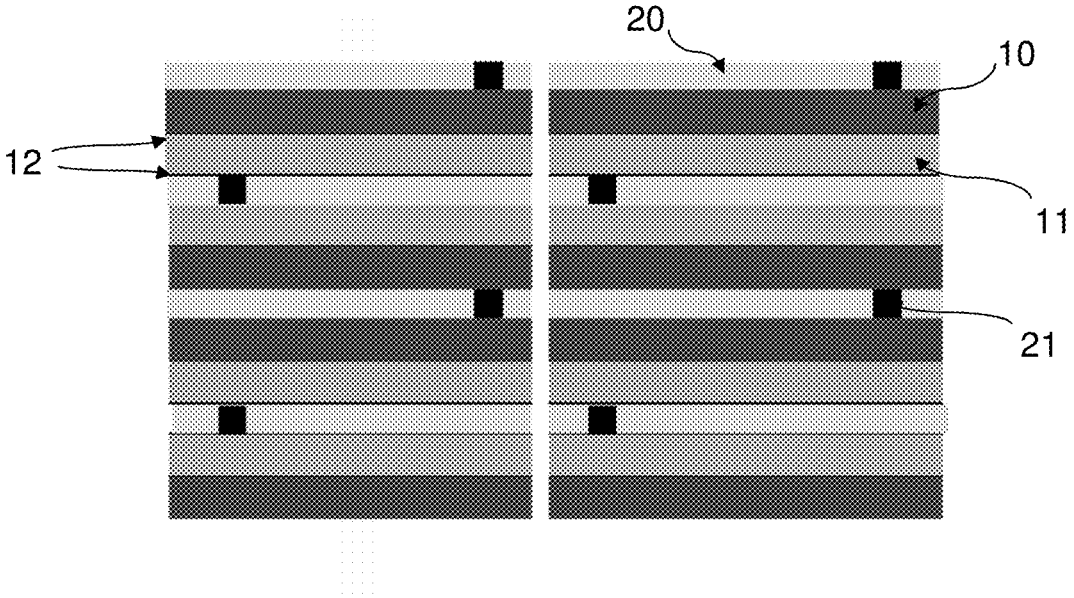
Figure 10:
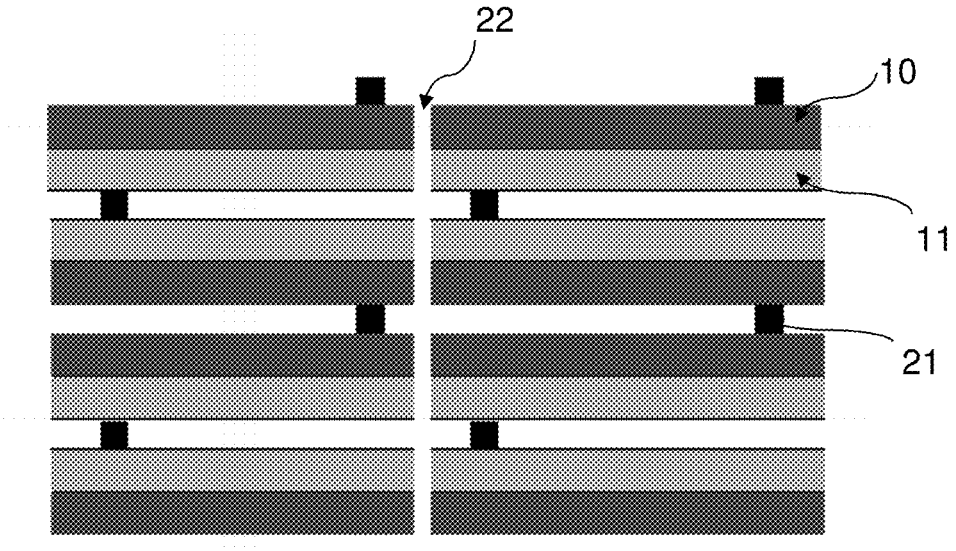
Figure 10:
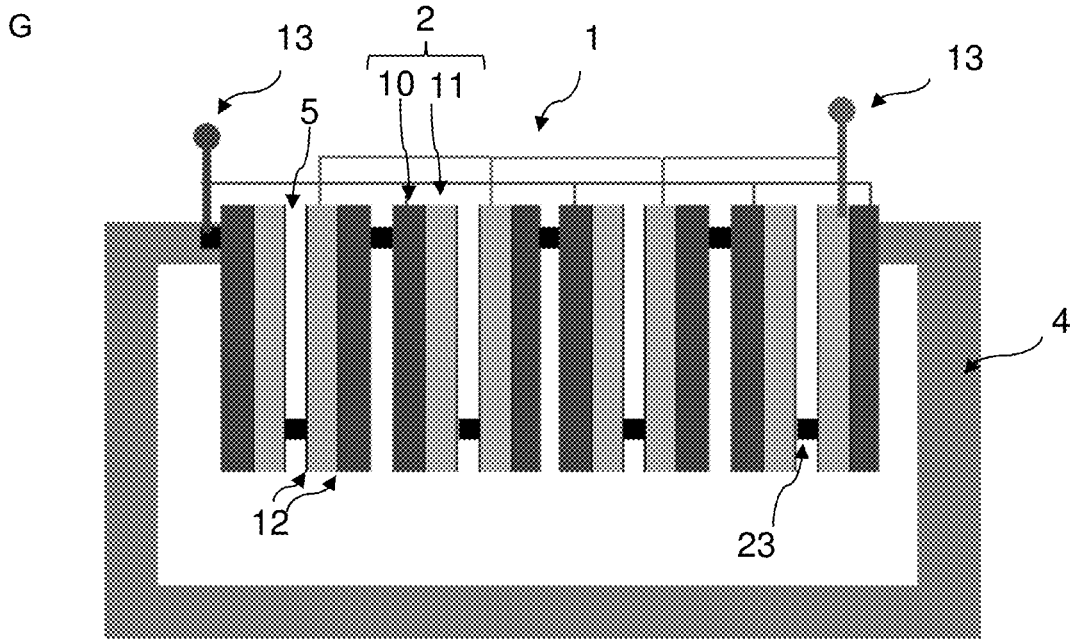

FIG. 10 illustrates a preferred manufacturing method for providing a MEMS loudspeaker with a vibratable membrane based on individual piezoceramics.

Firstly, a plurality of individual piezoceramic elements 19 are provided comprising a layer of mechanical support material 10 (e.g. doped polysilicon) and a layer of piezoelectric material 11 as well as a sacrificial layer 20 (see FIGS. 10, (A) and 10, (B)). The sacrificial layer 20 may be, for example, a photoresist. Preferably, the layer of mechanical support material 10 can be electrically conductive to ensure connection. It is also possible to apply one or two layers of conductive material 12 to the one layer of piezoelectric material 11, which serve to make an electrical connection with the piezoelectric material.

Subsequently, holes are defined for interlayer connection and metal filling 21 (see FIG. 10, (C)). The piezoceramic elements 19 are stacked (FIG. 10, (D)) and cut (dicing 22, FIG. 10, (F)) such that two or more stacks of piezoceramic elements 19 are obtained, which are connected by metal bridges 21 (see FIGS. 10, (E) and (F)).

After removal of the sacrificial layer 20 (FIG. 10, (F)), the stacked piezoceramic elements 19 are inserted into a carrier 4, preferably with the first and last piezoceramic elements each being connected to an electrode 13 (FIG. 10, (G)).

In this way, a vibratable membrane 1 is also obtained between a carrier 4, which comprises at least two or more vertical sections 2 for generating sound waves in a vertical direction of emission, which are formed parallel to the direction of emission and can be driven to vibrate horizontally.

The actuator principle is preferably also based here on a relative change in shape of the actuator layer 11 with respect to the mechanical support layer 10. A continuous actuator layer is not necessary for this. The connection of all vertical sections 2 by end-side driving is ensured by the metal bridges 23 in combination with conductive layers 12.

Figure 11:
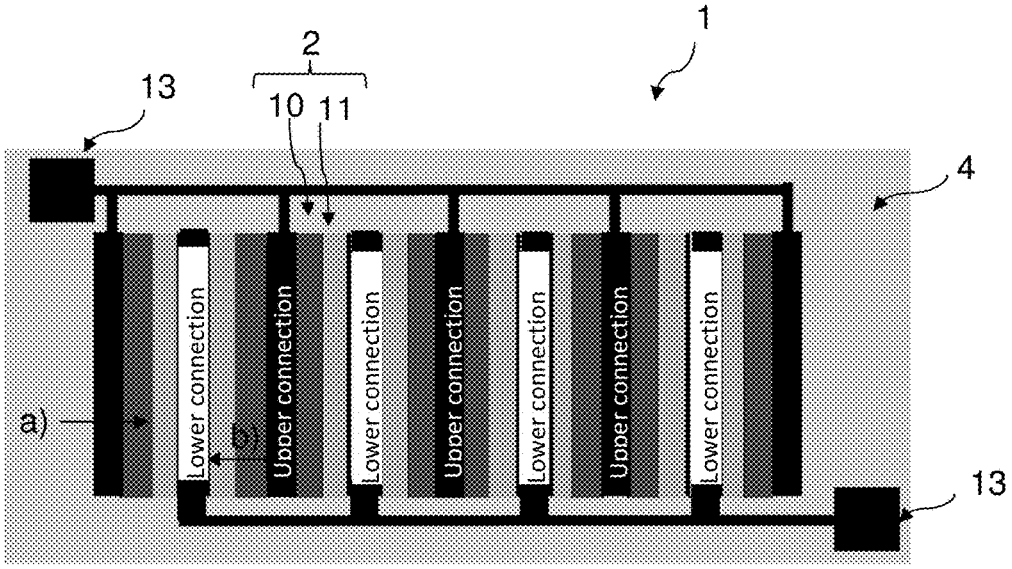
FIG. 11 Diagram of a preferred electrical connection of a MEMS loudspeaker with a vibratable membrane based on individual piezoceramics. (A) Top view of the MEMS loudspeaker. (B) Side view of the MEMS loudspeaker; (a) illustration of front side or upper side and rear side or lower side; (b) Parallel driving.
Figure 11:
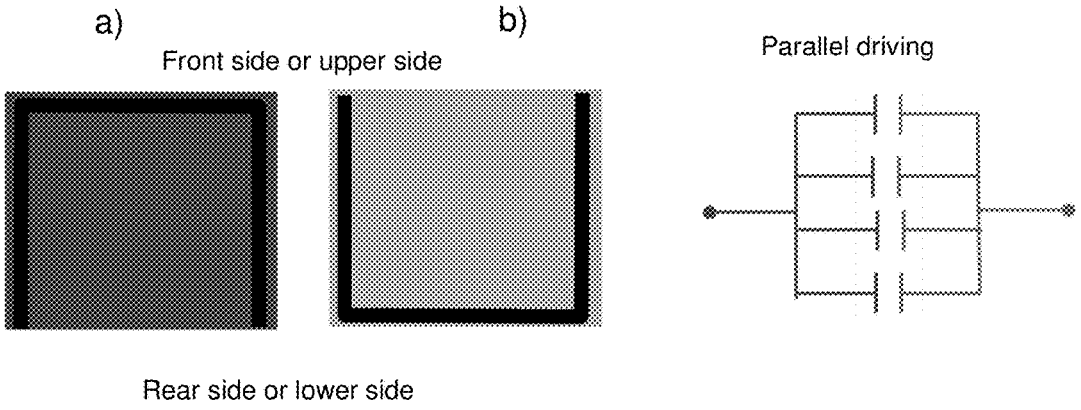

FIG. 11 illustrates a preferred electrical connection of the MEMS loudspeaker with a vibratable membrane based on individual piezoceramics.

FIG. 11, (A) is a top view and FIG. 11, (B) a side view of the MEMS loudspeaker. Individual lamellae or vertical sections are driven in parallel via the electrode pads 13, wherein u-shaped spacers are present on each side of the lamellae and create a mechanical and electrical connection to the next lamella.

Figure 12:
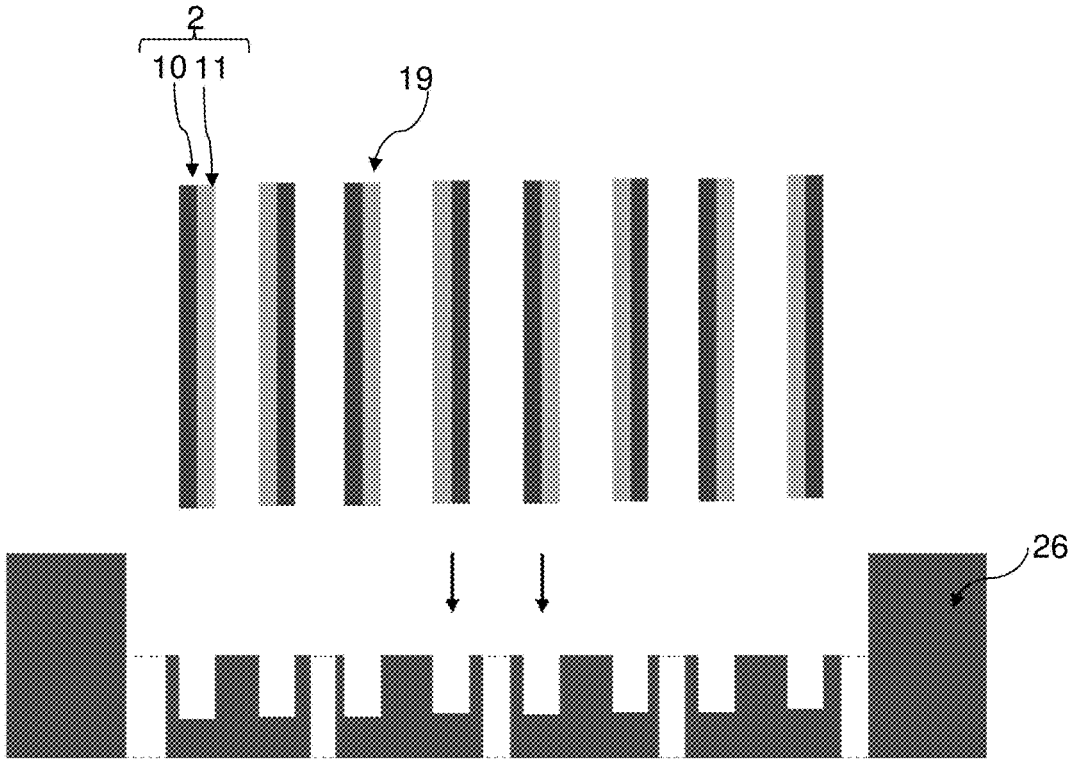
FIG. 12 Diagram of a preferred manufacturing method for a MEMS loudspeaker with a vibratable membrane based on individual piezoceramic elements. (A) To secure the piezoceramic elements 19, it may be preferred to use an adhesive, which is preferably first applied to recesses 27. (B) After securing the piezoceramic elements 19 in the respective recesses 27 of the lower frame 26, the adhesive can be applied to the piezoceramic elements 19 such that the upper frame secures the piezoceramic elements 19 on the upper side. (C) The composite frame 25, 26 may act as a carrier for the vertical sections 2.
Figure 12:
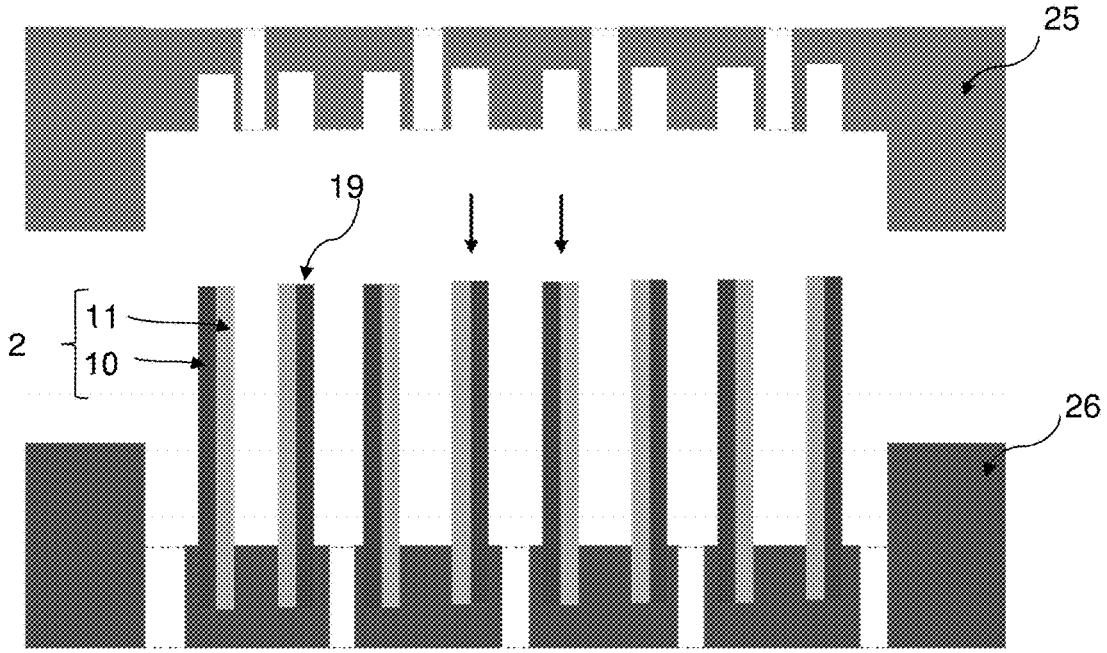
Figure 12:
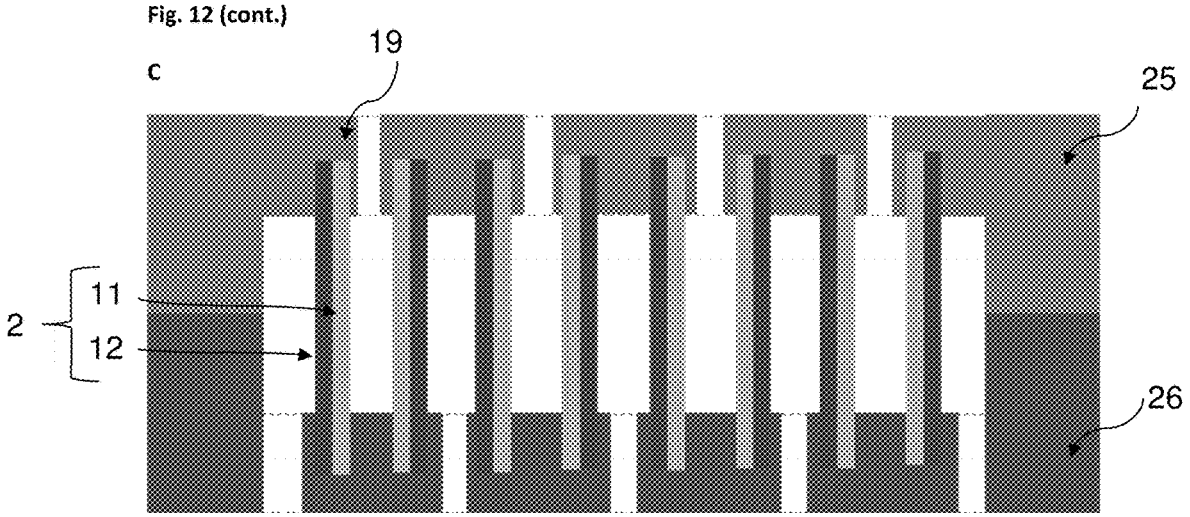

FIG. 12 illustrates an alternative manufacturing method for providing a MEMS loudspeaker with a vibratable membrane based on individual piezoceramics.

Advantageously, in contrast to the embodiment according to FIG. 10 or 11, structured connection can be dispensed with in the embodiment shown. Instead, as explained below, a connection can be made by means of a continuous conductive surface from the front (front electrode) or rear (backside electrode).

In a manner similar to the manufacturing method according to FIG. 10, a plurality of individual piezoceramic elements 19 are provided comprising a layer of mechanical support material 10 (e.g. doped polysilicon) and a layer of piezoelectric material 11. Preferably, the layer of mechanical support material 10 is electrically conductive.

Furthermore, an upper frame 25 and a lower frame 26 are provided respectively having recesses or grooves 27 for receiving the piezoceramic elements 19. Preferably, the upper and lower frames are made of an electrically non-conductive material, for example a polymer. Preferably, a 3D printing process can be used to form the frames.

To secure the piezoceramic elements 19, it may be preferred to use an adhesive, which is preferably first applied to recesses 27 (see FIG. 12, (A)). After securing the piezoceramic elements 19 in the respective recesses 27 of the lower frame 26, the adhesive can be applied to the piezoceramic elements 19 such that the upper frame secures the piezoceramic elements 19 on the upper side (see FIG. 12, (B)).

For the purpose of connecting the individual lamellae or piezoceramic elements 19, a continuous layer of conductive material, preferably metal, is preferably applied (not visibly) from the front (front electrode) or from the rear (backside electrode). For example, by means of a sputtering process.

In this manner, it is also possible to obtain a vibratable membrane 1 which, for the purpose of generating sound waves in a vertical direction of emission, comprises at least two or more vertical sections 2 which are formed parallel to the direction of emission and can be induced to vibrate horizontally. The composite frame 25, 26 may act as a carrier for the vertical sections 2.

REFERENCE LIST

1 Vibratable membrane
2 Vertical sections of the vibratable membrane
3 Horizontal sections of the vibratable membrane
4 Carrier
5 Air volumes between the vertical sections
8 Substrate
9 Etch stop
10 Layer of mechanical support material, preferably doped polysilicon
11 Layer of actuator material (actuator layer), preferably a piezoelectric material
12 Layer of conductive material, preferably metal
13 Connection of the electrode, preferably electrode pad
14 Retaining structures
15 Housing
16 Rear resonant volume
17 Ventilation opening
18 Layer of dielectric material
19 Piezoceramic element(s)
20 Sacrificial layer
21 Defined holes for interlayer connection with metal filling
22 Cutting (Dicing)
23 Metal bridges

24 Etching mask
25 Upper frame
26 Lower frame

LITERATURE

F. Stoppel, C. Eisermann, S. Gu-Stoppel, D. Kaden, T. Giese and B. Wagner, NOVEL MEMBRANE-LESS TWO-WAY MEMS LOUDSPEAKER BASED ON PIEZO-ELECTRIC DUAL-CONCENTRIC ACTUATORS, Transducers 2017, Kaohsiung, TAIWAN, Jun. 18-22, 2017.

Iman Shahosseini, Elie LEFEUVRE, Johan Moulin, Marion Woytasik, Emile Martincic, et al. Electromagnetic MEMS Microspeaker for Portable Electronic Devices. Microsystem Technologies, Springer Verlag (Germany), 2013, pp.10. <hal-01103612>.

Bert Kaiser, Sergiu Langa, Lutz Ehrig, Michael Stolz, Hermann Schenk, Holger Conrad, Harald Schenk, Klaus Schimmanz and David Schuffenhauer, Concept and proof for an all-silicon MEMS microspeaker utilizing air chambers Microsystems & Nanoengineering volume 5, Article number: 43 (2019).

Kazuo Sato, Mitsuhiro Shikida, Yoshihiro Matsushima, Takashi Yamashiro, Kazuo Asaumi, Yasuroh Nye, and Masaharu Yamamoto, Characterization of orientation-dependent etching properties of single-crystal silicon: effects of KOH concentration, Sensors and Actuators A 64 (1988) 87-93).

Seidel, H., Csepregi, L., Neuberger, A., and Baumgartel, H. (1990). Anisotropic etching of Crystalline Silicon in Alkaline Solutions. Journal of The Electrochemical Society 137. 10.1149/1.2086277.

The invention claimed is:

1. A microelectromechanical system (MEMS) transducer for interacting with a volume flow of a fluid comprising a carrier, a vibratable membrane for generating or receiving pressure waves of the fluid in a vertical direction, the vibratable membrane being supported by the carrier, wherein the vibratable membrane is manufactured together with the carrier in a semiconductor process, wherein the vibratable membrane exhibits two or more vertical sections formed substantially parallel to the vertical direction and comprising at least one layer of an actuator material, wherein at least one end of the vibratable membrane is connected to at least one electrode, such that the two or more vertical sections can be induced to vibrate horizontally by driving the at least one electrode or such that an electrical signal can be generated at the at least one electrode when the two or more vertical sections are induced to vibrate horizontally.

2. The MEMS transducer according to claim 1, wherein the MEMS transducer is a MEMS loudspeaker, wherein air volumes are present between the vertical sections, which, as a result of the horizontal vibrations, are moved along a vertical direction of emission to generate sound waves, or the MEMS transducer is a MEMS microphone, wherein air volumes are present between the vertical sections, which are moved along a vertical direction of detection when sound waves are received.

3. The MEMS transducer according to claim 1, wherein the two or more vertical sections comprise at least two layers, one layer comprising an actuator material and a second layer comprising a mechanical support material, wherein at least the layer comprising the actuator material is connected to an electrode, such that horizontal vibrations can be generated by a change in shape of the actuator material relative to the mechanical support material or such that horizontal vibrations cause a change in shape of the actuator material relative to the mechanical support material and generate an electrical signal.

4. The MEMS transducer according to claim 1, wherein the two or more vertical sections comprise at least two layers, both layers comprising an actuator material and each being connected respectively to an electrode, and the horizontal vibrations being able to be generated by a change in shape of one layer relative to the other layer, or the horizontal vibrations causing a change in shape of one layer relative to the other layer and generating an electrical signal.

5. The MEMS transducer according to claim 1, wherein the carrier comprises two side regions between which the vibratable membrane is arranged in a horizontal direction.

6. The MEMS transducer according to claim 1, wherein the vibratable membrane is formed by a lamellar structure or meander structure.

7. The MEMS transducer according to claim 1, wherein the vibratable membrane is formed by a meander structure with alternating vertical and horizontal sections, at least two of the horizontal sections having attached to them retaining structures which are connected directly or indirectly to the carrier.

8. The MEMS transducer according to claim 1, wherein the actuator material comprises a piezoelectric material, a polymer piezoelectrical material and/or electroactive polymers (EAP).

9. The MEMS transducer according to claim 8 wherein the piezoelectric material is selected from a group comprising lead zirconate titanate (PZT), aluminum nitride (AlN), aluminum scandium nitride (AlScN) and zinc oxide (ZnO).

10. The MEMS transducer according to claim 1, wherein the vibratable membrane comprises three layers, an upper layer being formed by a conductive material, a middle layer being formed by an actuator material, and a lower layer being formed by a conductive material, wherein the conductive material of the upper and/or lower layer is preferably a mechanical support material.

11. The MEMS transducer according to claim 1, wherein the vibratable membrane comprises two layers of actuator material, which are separated by a middle layer of conductive material, wherein the middle layer is connected to a first electrode and at least one of the two layers of actuator material is connected to a second electrode via a further layer of conductive material.

12. The MEMS transducer according to claim 1, wherein the vibratable membrane is coated with a layer of a non-stick material.

13. The MEMS transducer according to claim 1, wherein the vibratable membrane supported by the carrier is arranged in a front side of a housing which encloses a rear resonant volume.

14. The MEMS transducer according to claim 13 wherein a ventilation opening is present in the housing for avoiding acoustic short circuits and/or for supporting the sound.

15. A manufacturing method for a MEMS transducer according to claim 1 comprising the following steps:

etching of a substrate to form a structuring, applying at least two layers, wherein at least a first layer comprises an actuator material and a second layer comprises a mechanical support material, or at least two layers comprise an actuator material, connecting the first and/or second layer to an electrode, and etching and optional removal of the etch stop, such that a vibratable membrane is supported by a carrier formed by the substrate, the vibratable membrane comprising at least two or more vertical sections for generating or receiving pressure waves of the fluid in a vertical direction, which sections are formed parallel to the vertical direction and such that the two or more vertical sections can be induced to vibrate horizontally by driving the at least one electrode, or such that when the two or more vertical sections are induced to vibrate horizontally, an electrical signal can be generated at the at least one electrode.

16. The method of claim 15, further comprising applicating an etch stop.

17. The MEMS transducer according to claim 1 wherein the carrier is formed of a substrate selected from the group consisting of monocrystalline silicon, polysilicon, silicon dioxide, silicon carbide, silicon germanium, silicon nitride, nitride, germanium, carbon, gallium arsenide, gallium nitride, indium phosphide and glass.

18. A MEMS transducer for interacting with a volume flow of a fluid comprising a carrier, a vibratable membrane for generating or receiving pressure waves of the fluid in a vertical direction, the vibratable membrane being supported by the carrier, wherein the vibratable membrane exhibits two or more vertical sections formed substantially parallel to the vertical direction and comprising at least one layer of an actuator material, wherein at least one end of the vibratable membrane is connected to at least one electrode, such that the two or more vertical sections can be induced to vibrate horizontally by driving the at least one electrode or such that an electrical signal can be generated at the at least one electrode when the two or more vertical sections are induced to vibrate horizontally, and wherein the vertical sections of the vibratable membrane comprise two layers, wherein a first layer consists of an actuator material, a second layer consists of a conductive support material and wherein the vertical sections are connected via horizontal metal bridges and wherein the vertical sections are respectively connected to an electrode.

19. The manufacturing method for a MEMS transducer according to claim 18 comprising the following steps:

obtaining a plurality of individual piezoceramic elements comprising a sacrificial layer, a layer of conductive material, and a layer of piezoelectric material, defining holes for interlayer connection in the piezoceramic elements and metal filling, stacking the piezoceramic elements so as to obtain a stack of piezoceramic elements connected by metal bridges, and removing the sacrificial layer and insertion of the stack of piezoceramic elements into a carrier, wherein the piezoceramic elements are respectively connected to an electrode, such that a vibratable membrane is supported by the carrier, the vibratable membrane comprising at least two or more vertical sections for generating or receiving pressure waves of the fluid in a vertical direction, which sections are formed parallel to the vertical direction and such that the two or more vertical sections can be induced to vibrate horizontally by driving the at least one electrode, or such that when the two or more vertical sections are induced to vibrate horizontally, an electrical signal can be generated at the at least one electrode.

20. The method of claim 19, further comprising during the stacking of the piezoceramic elements a step of dicing them.

* * * * *